US010995592B2

(12) United States Patent
Imhof et al.

(10) Patent No.: US 10,995,592 B2
(45) Date of Patent: May 4, 2021

(54) METHOD AND SYSTEM FOR ANALYZING THE UNCERTAINTY OF SUBSURFACE MODEL

(71) Applicants: Matthias Imhof, Katy, TX (US); Mary Ellen Meurer, Pearland, TX (US)

(72) Inventors: Matthias Imhof, Katy, TX (US); Mary Ellen Meurer, Pearland, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 741 days.

(21) Appl. No.: 14/816,729

(22) Filed: Aug. 3, 2015

(65) Prior Publication Data

US 2016/0090825 A1 Mar. 31, 2016

Related U.S. Application Data

(60) Provisional application No. 62/057,797, filed on Sep. 30, 2014.

(51) Int. Cl.

| | |
|---|---|
| ***G06G 7/48*** | (2006.01) |
| ***E21B 43/00*** | (2006.01) |
| *E21B 41/00* | (2006.01) |

(52) U.S. Cl.

CPC ..... *E21B 43/00* (2013.01); *E21B 41/00* (2013.01)

(58) Field of Classification Search

None

See application file for complete search history.

(56) References Cited

U.S. PATENT DOCUMENTS

| | | | | |
|---|---|---|---|---|
| 7,164,990 | B2 | 1/2007 | Bratvedt et al. | |
| 7,248,259 | B2 | 7/2007 | Fremming | |
| 7,756,694 | B2 | 7/2010 | Graf et al. | |
| 8,213,261 | B2 | 7/2012 | Imhof et al. | |
| 8,360,144 | B2 | 1/2013 | Imhof | |
| 8,437,997 | B2 * | 5/2013 | Meurer | G01V 11/00 703/10 |
| 8,612,195 | B2 * | 12/2013 | Sun | G01V 11/00 703/10 |
| 8,855,987 | B2 | 10/2014 | Imhof et al. | |

(Continued)

FOREIGN PATENT DOCUMENTS

| | | |
|---|---|---|
| WO | WO 2007/106244 | 9/2007 |
| WO | WO 2014/070296 | 5/2014 |

(Continued)

OTHER PUBLICATIONS

Durand-Riard et al. Balanced Restoration of Geological Volumes With Relaxed Meshing Constraints Computers and Geosciences, Nov. 17, 2010 pp. 1-26.*

(Continued)

*Primary Examiner* — Rehana Perveen
*Assistant Examiner* — Cuong V Luu
(74) *Attorney, Agent, or Firm* — ExxonMobil Upstream Research Company—Law Department

(57) ABSTRACT

A method for examining uncertainty and risk associated with the development of a hydrocarbon resource by rapidly generating and analyzing variations of reservoir models realized from scenarios. The method and system may include instantiating realizations for objects based on the selected parameter ranges; and combining instantiated realizations of the objects into a reservoir model.

17 Claims, 8 Drawing Sheets

(56) References Cited

U.S. PATENT DOCUMENTS

| | | | | |
|---|---|---|---|---|
| 9,008,972 | B2 | 4/2015 | Imhof et al. | |
| 2007/0297858 | A1* | 12/2007 | Imbrie | B09C 1/002 405/128.45 |
| 2010/0088082 | A1* | 4/2010 | Ingham | E21B 41/00 703/10 |
| 2010/0235154 | A1* | 9/2010 | Meurer | G01V 11/00 703/10 |
| 2011/0048731 | A1 | 3/2011 | Imhof et al. | |
| 2012/0006560 | A1* | 1/2012 | Calvert | E21B 43/00 166/369 |
| 2012/0099396 | A1* | 4/2012 | Hoelting | G01V 1/301 367/73 |
| 2012/0209526 | A1* | 8/2012 | Imhof | G01V 1/306 702/5 |
| 2012/0253770 | A1* | 10/2012 | Stern | G01V 11/00 703/10 |
| 2012/0261135 | A1* | 10/2012 | Nowak | G01V 1/301 166/369 |
| 2012/0265510 | A1 | 10/2012 | Lepage | |
| 2012/0316847 | A1* | 12/2012 | Hantschel | G06Q 10/00 703/2 |
| 2012/0317478 | A1* | 12/2012 | Hantschel | G01V 99/00 715/255 |
| 2013/0064040 | A1* | 3/2013 | Imhof | G01V 1/306 367/73 |
| 2013/0090857 | A1* | 4/2013 | Imhof | G01V 1/301 702/14 |
| 2013/0151161 | A1* | 6/2013 | Imhof | G01V 1/003 702/14 |
| 2013/0211807 | A1* | 8/2013 | Templeton-Barrett | E21B 43/26 703/10 |
| 2013/0218539 | A1 | 8/2013 | Souche | |
| 2013/0246031 | A1* | 9/2013 | Wu | G06T 17/05 703/10 |
| 2014/0118350 | A1 | 5/2014 | Imhof et al. | |
| 2014/0278311 | A1 | 9/2014 | Dimitrov et al. | |
| 2014/0303896 | A1 | 10/2014 | Wrobel et al. | |
| 2014/0345857 | A1 | 11/2014 | Imhof | |
| 2014/0358445 | A1 | 12/2014 | Imhof et al. | |
| 2014/0365132 | A1 | 12/2014 | Imhof et al. | |
| 2017/0140079 | A1* | 5/2017 | Gentilhomme | G01V 1/282 |

FOREIGN PATENT DOCUMENTS

| | | |
|---|---|---|
| WO | WO 2014/074213 | 5/2014 |
| WO | WO 2014/150262 | 9/2014 |
| WO | WO 2014/150580 | 9/2014 |

OTHER PUBLICATIONS

Hirsch et al. Graph Theory Applications to Continuity and Ranking in Geologic Models Computer and Geosciences 25, 1999 pp. 127-139.*

Pei et al. Spreading Dynamics in Complex Networks Journal of Statistical Mechanics Theory and Experiment, Dec. 22, 2013 pp. 1-23.*

Cherpeau, N. et al., "Stochastic simulations of fault networks in 3D structural modeling," *Comptes Rendus Geoscience* 342(9), pp. 687-694, 2010.

Hirsch, L.M. et al., "Graph theory applications to continuity and ranking in geologic models," *Computers & Geosciences* 25, pp. 127-139, 1999.

Holden, L. et al., "Stochastic Structural Modeling," *Mathematical Geology* 35(8), pp. 899-913, Nov. 2003.

López-Pintado et al., "On the Concept of Depth for Functional Data," *J. of the American Statistical Association* 104(486), pp. 718-734, Jun. 2009.

Røe, P. et al., "Flexible Simulation of Faults," SPE 134912, SPE Annual Tech. Conf. and Exh. in Florence, Italy, Sep. 2010, 8 pgs.

Sun, Y. et al., "Functional Boxplots," *J. of Computational and Graphical Statistics* 20(2), pp. 316-334, 2011.

Suzuki, S. et al., "Dynamic data integration for structural modeling: model screening approach using a distance-based model parameterization," *Computational Geoscience* 12, pp. 105-119, 2008.

Thore, P. et al., "Structural uncertainties: Determination, management, and applications," *Geophysics* 67(3), pp. 840-852, May-Jun. 2002.

Whitaker, R.T. et al., "Contour Boxplots: A Method for Characterizing Uncertainty in Feature Sets from Simulation Ensembles," *IEEE Transactions on Visualization and Computer Graphics* 19(12), pp. 2713-2722, Dec. 2013.

* cited by examiner

METHOD AND SYSTEM FOR ANALYZING THE UNCERTAINTY OF SUBSURFACE MODEL

CROSS-REFERENCE TO RELATED APPLICATION

This application claims the benefit of U.S. Provisional Patent Application 62/057,797, filed Sep. 30, 2014, entitled METHOD AND SYSTEM FOR ANALYZING THE UNCERTAINTY OF SUBSURFACE MODEL, the entirety of which is incorporated by reference herein.

FIELD OF THE INVENTION

This invention relates generally to the field of hydrocarbon exploration and extraction. Specifically, the invention is a method to examine uncertainty and risk associated with the development of a hydrocarbon resource by rapidly generating and analyzing variations of subsurface models realized from different scenarios.

BACKGROUND

This section is intended to introduce various aspects of the art, which may be associated with exemplary embodiments of the present disclosure. This discussion is believed to assist in providing a framework to facilitate a better understanding of particular aspects of the disclosed methodologies and techniques. Accordingly, it should be understood that this section should be read in this light, and not necessarily as admissions of prior art.

Typically, a geologic model is formed that includes various static properties. From the geologic model, a reservoir model is created to model dynamic properties. For example, the reservoir model is formed from geological horizons and faults. The reservoir model includes a framework that establishes the geometrical foundation for the three-dimensional grid and provides some of the boundaries for facies and petrophysical models that describe rock properties and contained fluids. The resulting reservoir model forms the basis for volumetric computations, reservoir simulations, facilities planning computations and well planning computations. While seismic and well data provide information regarding the reservoir model, considerable uncertainty may remain regarding the reservoir model.

The effect of uncertainty is often examined through various means. For example, the uncertainty may be examined by perturbing uncertain aspects or features of the reservoir model, recomputing the quantity of interest, and examining sensitivity of the quantity of interest with regard to the uncertain aspects. The problem with framework uncertainty related to the geometric foundation of the three-dimensional grid is that the steps between framework generation, definition of the grid, and computation of the quantity of interest are computationally and labor intensive, often requiring user input.

Some conventional methods only perturb the depth of different model objects, such as faults and horizons. The depth perturbation may be spatially variable, for example allowing the flanks of an anticline to be pushed down or pulled up, while leaving the crest unperturbed. The resulting flexing of faults, horizons and other model objects occurs in the vertical direction, however, and the modeling grid is flexed simultaneously. That is, the geometry of the grid changes, but not its structure.

Providing vertical and lateral movement of the model objects typically requires grid regeneration. Some conventional methods attempt to correct the existing grid. Other conventional methods move the model objects vertically and laterally and then adjust the intersections. The adjustment has two aspects, however, the removal of the original intersections and the implementation of the new intersections. For example, when a fault is shifted, a portion of a bisected horizon moves from the foot-wall side to the hanging-wall side or vice versa. The moving horizon piece has a previous displacement that should be undone. Typically, the undoing of previous displacements appears to be performed by deletion of horizons near faults and extrapolation towards the shifted fault. See, e.g., Røe et al., 'Flexible Simulation Of Faults', SPE 134912, 2010; Cherpeau et al., 'Stochastic Simulations of Fault Networks in 3D Structural Modeling', Comptes Rendus Geoscience, 342, 687-694, 2010; Suzuki et al., 'Dynamic Data Integration For Structural Modeling: Model Screening Approach Using Distance-Based Model Parameterization', Computational Geosciences, 12, 105-119, 2008; Holden et al., 'Stochastic Structural Modeling', 35(8), 899-913, 2003; and Thore et al., 'Structural Uncertainties: Determination, Management And Applications', Geophysics, 67(3), 840-852, 2002.

As a result, an enhancement to exploration and reservoir delineation techniques is needed to identify and recover hydrocarbons in light of imprecise data. The present techniques provide a streamlined method for generation of a perturbed framework and thus a perturbed reservoir model. Further, the enhancements may provide a method for systematic removal of the effects of faults and folds to provide numerous realizations of the reservoir model in an efficient manner. The enhancements may provide a method to explore fault connectivity or check for geologic plausibility and technical validity which removes problematic model perturbation.

SUMMARY

In one embodiment, a method is described. The method includes analyzing uncertainty of subsurface formations and includes: creating a conceptual subsurface model, wherein the conceptual subsurface model is associated with a subsurface formation and comprises a plurality of objects; selecting parameter ranges for each of the plurality of objects and interactions between two or more of the plurality of objects; instantiating realizations for the plurality of objects based on the selected parameter ranges; and combining instantiated realizations of the plurality of objects into a reservoir model.

In yet another embodiment, a computer system for analyzing uncertainty of subsurface formations for production or exploration operations is described. The computer system may include a processor; memory in communication with the processor; and a set of instructions stored in memory and accessible by the processor. The set of instructions, when executed by the processor, are configured to: create a conceptual subsurface model, wherein the conceptual subsurface model is associated with a subsurface formation and comprises a plurality of objects; select parameter ranges for each of the plurality of objects and interactions between two or more of the plurality of objects; instantiate realizations for the plurality of objects based on the selected parameter ranges; and combine instantiated realizations of these objects into a reservoir model.

BRIEF DESCRIPTION OF THE DRAWINGS

The foregoing and other advantages of the present disclosure may become apparent upon reviewing the following detailed description and drawings of non-limiting examples of embodiments.

DETAILED DESCRIPTION

Figure 1:
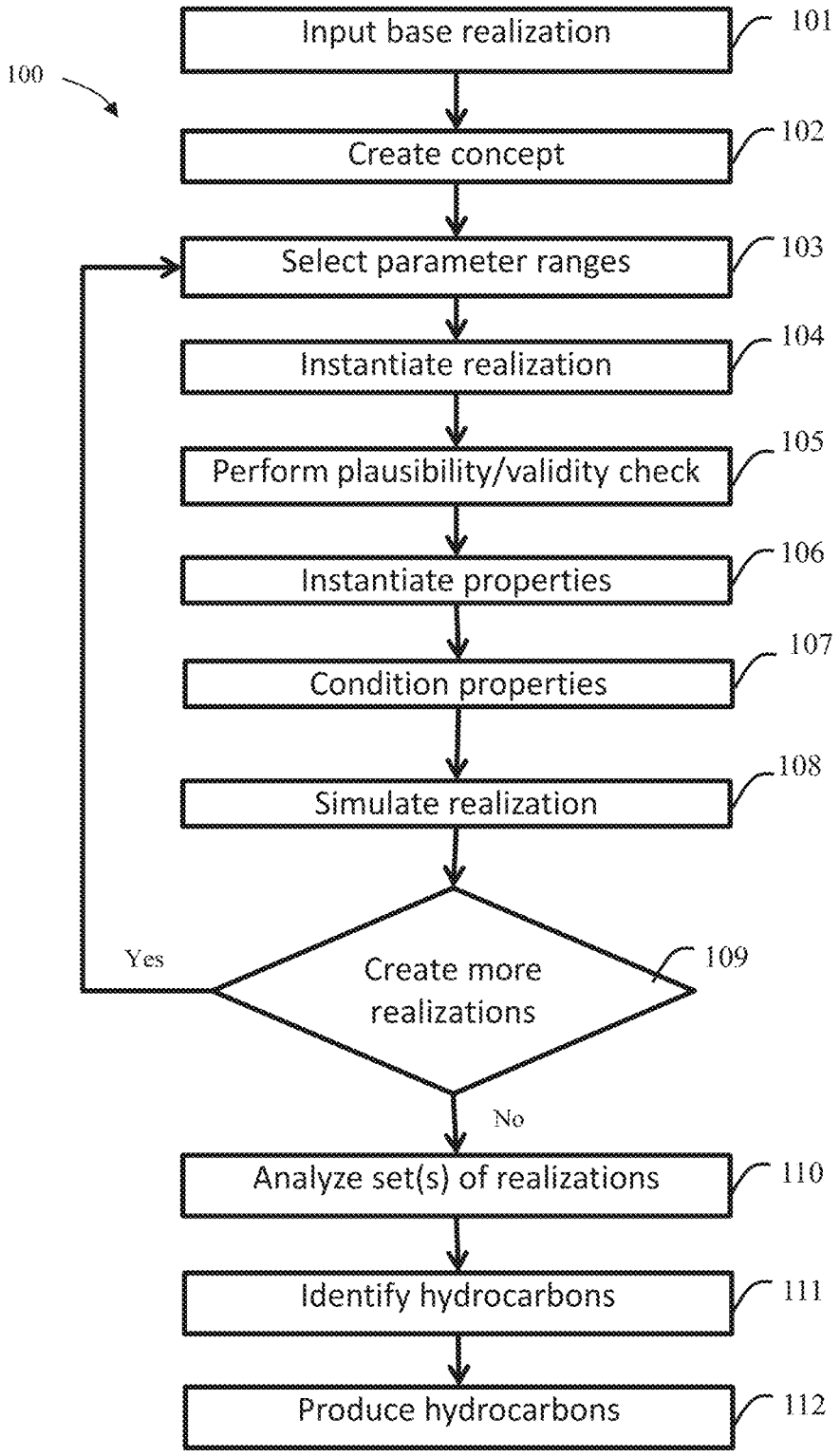
FIG. 1 is a flow chart for performing hydrocarbon exploration in accordance with an exemplary embodiment of the present techniques.

In the following detailed description section, the specific embodiments of the present disclosure are described in connection with preferred embodiments. However, to the extent that the following description is specific to a particular embodiment or a particular use of the present disclosure, this is intended to be for exemplary purposes only and simply provides a description of the exemplary embodiments. Accordingly, the disclosure is not limited to the specific embodiments described below, but rather, it includes all alternatives, modifications, and equivalents falling within the true spirit and scope of the appended claims.

Various terms as used herein are defined below. To the extent a term used in a claim is not defined below, it should be given the broadest definition persons in the pertinent art have given that term as reflected in at least one printed publication or issued patent.

"Subsurface model", as used herein, is a reservoir model or a geologic model.

"Geologic model", as used herein, is three-dimensional model of the subsurface having static properties and includes faults, horizons, facies, lithology and properties such as porosity, permeability, or the proportion of sand and shale.

"Reservoir model", as used herein, is a three-dimensional model of the subsurface that in addition to static properties such as porosity and permeability also has dynamic properties that vary over the timescale of resource extraction such as fluid composition, pressure, and relative permeability.

"Framework", as used herein, is a geologic model formed from faults, horizons, model boundaries, and facies boundaries, e.g., a geologic model containing only surfaces and polylines.

"Concept", as used herein, is a model containing faults, horizons, and facies boundaries without geometry or location. Aspects of the geologic or reservoir models related to geometry and location are suppressed. For example, a concept is often conveyed as a sketch of only the objects deemed most pertinent, omitting anything else.

"Scenario", as used herein, is a concept or partial subsurface model in combination with select parameters and their ranges used to build realizations of subsurface models by deterministically or stochastically varying these parameters. Examples may be normal faults versus reverse faults, different time-depth conversions or environments of deposition, or high net-to-gross versus low-net-to-gross regions.

"Realization", as used herein, is a subsurface model (e.g., geologic model) created from a concept or scenario by assigning geometry and location to faults, horizons, and boundaries; and values to properties which may be utilized for computations and quantitative queries.

"Instantiate", as used herein, is the process of transforming a (qualitative) concept or object thereof to a (quantitative) realization or object thereof. Instantiation may be performed by interpolation or extrapolation of measurements or by application of a stochastic process.

"Simulate", as used herein, is the process of making a prediction related to the resource extraction based on the reservoir model. A simulation is typically performed by execution of a reservoir-simulator computer program on a processor, which computes composition, pressure, or movement fluid as function of time and space for a specified scenario of injection and production wells by solving a set of reservoir fluid flow equations.

"Unfaulting operation", as used herein, is the process of undoing the effects of a fault on the other objects of the model. A horizon typically exhibits a discontinuity where intersected by a fault. When this fault is turned into a conceptual fault, its location and geometry are removed. Remaining model objects, however, still exhibit the discontinuities caused by the original fault. The unfaulting operation removes these discontinuities, returning the remaining objects to a state unaffected by this fault, e.g., to a state where the fault never existed.

"Refaulting operation", as used herein, is the process of affecting the other model objects of a model when a fault is realized. The typical effect is the generation of discontinuities where the fault and existing objects intersect.

"Unfolding operation", as used herein, is process of at least partially removing location and geometry from a horizon transforming a horizon into a conceptual horizon. An unfolding operation removes the effects of a folding event (continuous deformation) from the model.

"Refolding operation", as used herein, is the process of applying a continuous deformation to the objects, either by assignment or perturbation of geometry and location to horizons and specified other objects.

To begin, a subsurface model, which may include a reservoir model or geologic model, is a computerized representation of a subsurface region based on geophysical and geological observations made on and below the surface of the Earth. It is the numerical equivalent of a three-dimensional geological map complemented by a description of physical quantities in the domain of interest. Subsurface models, which are reservoir models, are often used as inputs to reservoir simulation programs that predict the behavior of rocks and fluids contained therein under various scenarios of hydrocarbon recovery. When producing an actual hydrocarbon reservoir, miscalculations or mistakes can be costly. Using subsurface models in simulations provides a mechanism to identify which recovery options offer the safest and most economic, efficient, and effective development plans for a particular reservoir.

Construction of a subsurface model is typically a multi-step process. First, a structural model or structural framework is created from surfaces that include faults, horizons, and if necessary, additional surfaces that bound the area of interest for the geologic model. The different surfaces define closed volumes often called zones. Second, each zone is meshed or partitioned into small cells defined by a three-dimensional grid. Lastly, properties are assigned to surfaces (e.g., transmissibility) and individual cells (e.g., rock type, porosity, permeability, or oil saturation).

The assignment of cell properties is often a two-step process where each cell is first assigned a rock type, and then each rock type is assigned spatially-correlated reservoir properties and/or fluid properties. Each cell in the model is assigned a rock type. For example, in a coastal clastic environment, the cells may be beach sand, high water energy marine upper shoreface sand, intermediate water energy marine lower shoreface sand, and deeper low energy marine silt and shale. The distribution of these rock types within the model may be controlled by several methods, including map boundary polygons, rock type probability maps, or statistically emplaced based on concepts. Where available, rock type assignment may be conditioned to well data.

Reservoir quality parameters typically include porosity and permeability, but may include measures of clay content, cementation factors, and other factors that affect the storage and deliverability of fluids contained in the pores of those rocks. Geostatistical techniques are typically used to populate the cells with porosity and permeability values that are appropriate for the rock type of each cell. Rock pores are saturated with groundwater, oil or gas. Fluid saturations may be assigned to the different cells to indicate which fraction of their pore space is filled with the specified fluids. Fluid saturations and other fluid properties may be assigned deterministically or geostatistically.

Geostatistics is useful in modeling to interpolate observed data and to superimpose an expected degree of variability. As an example, kriging, which uses the spatial correlation among data and intends to construct the interpolation via semi-variograms, may be used. To reproduce more realistic spatial variability and help assessing spatial uncertainty between data, geostatistical simulation is often used, for example based on variograms, training images, or parametric geological objects. Perturbing surface properties or cell properties, such as rock type, reservoir properties or fluid properties, is a conventional process, which may utilize deterministic or geostatistical methods to assign them. The assignment may include choosing a different variogram for kriging or a different seed for geostatistical simulation.

For the purpose of this disclosure, a realization is instantiated from a concept. The difference between a concept and a realization is a complete geometry. In a realization, objects, such as points, polylines, polygons, horizons, faults, or compartments, have locations, relative positions with regard to each other, shapes, or sizes. The topology of the objects (e.g., their interactions) of the realization is defined. In a realization, a property attached to an object has values at essentially every location of the object. In summary, a realization does not contain free parameters anymore. On the other hand, a concept contains free parameters relating to topology, geometry, and properties. A concept does not have geometry associated with its objects. At least some of the points, polylines, polygons, horizons, faults, or compartments do not have their locations, relative positions with regard to each other, shapes, or sizes defined. The topology of its objects can be completely specified, partially specified, or unspecified. For example, the order in which different horizons and faults terminate may be undefined. In some embodiments, the nature or interpretation of an object may be undefined. In a realization, a horizon is (either implicitly or explicitly) typed conformable, basal, topal, erosional, or discontinuous while in a concept, the horizon type can but does not need to be specified. In a realization, a fault is typed normal, reverse, or strike-slip, while in a concept, the fault type can but does not need to be typed. In a concept, the cardinality of an object can be undefined. In some embodiments, a single fault in the concept may be realized as multiple faults, for example, by realizing a fault as a set of relay faults or as a set of parallel faults.

One of the largest uncertainties in reservoir modeling relates to the framework formed by faults and certain horizons because this framework controls volumetrics and connectivity. Framework uncertainty is caused by uncertainty in seismic migration, time-depth (or depth-true depth) conversion, structural interpretation, fault positions, well picks, horizon correlation and interpretation, and layer thicknesses. Unfortunately, framework changes tend to create artifacts that have to be addressed. Accordingly, the present techniques provide a method and system for modifying an existing watertight (e.g., sealed) framework in such a manner that the resulting framework is yet again watertight without gaps or overlaps between model cells or reservoir compartments.

The present techniques involve a workflow that may be used to analysis uncertainty and risk associated with the development of hydrocarbon resources by rapidly generating and analyzing variations of subsurface models realized from scenarios. Under the present techniques, structural artifacts may be removed once by systematic removal of the effects of faults and folds. In this manner, numerous realizations of the subsurface model can then be generated by starting with an initial starting subsurface model and the corresponding concept and then, iteratively computing the effects of faults and folds on the revised starting subsurface model.

The present techniques may also include the ability to omit a fault or fold from the perturbed model or to introduce additional faults and folds into the perturbed model. This capability allows the exploration of fault connectivity, for example the substitution of one long contiguous fault by a set of fault relays. Further still, the method may also include a performance of a check for geologic plausibility and technical validity which removes problematic model perturbations from the workflow or at least from the set of simulation results used for the final analysis.

In certain embodiments, the workflow may include various steps. For example, as a first step, each horizon is unfaulted one fault at a time. Each unfaulting operation removes a tear in a horizon, bringing its edges back together. A fault causes a discontinuity in a given horizon. Unfaulting removes this discontinuity by adjusting the depths of the horizon near fault and propagating or extrapolating these adjustments away from the fault along the horizon. As a second step, the overarching remaining structure of now fault-free horizons is removed. This unfolding is performed by replacing the horizon with an approximately planar one while recording the necessary vertical depth adjustments. As a third step, a different overarching structure is imposed on the horizons. This refolding is performed by replacing the approximately planar horizons with differently shaped ones, preferably guided by the previously recorded adjustments. In the fourth step, the horizons are refaulted. The refaulting is performed by moving the horizon on the different sides of the fault to the desired relative location and propagating these adjustments away from the fault along the horizon. Unfaulting (F−1), refaulting (F), unfolding (S−1), and refolding (S) may be viewed as mappings, transforms, and/or operators suggesting the notation F−1, F, S−1, S. If the workflow is performed with the refaulting operator being the inverse of the unfaulting operator (F 1*F=I) and the refolding operator being the inverse of the refolding operator (S−1*S=I), then the resulting framework should be identical to the existing framework. However, if the folding operator and/or the faulting operator are modified, then the resulting framework is a perturbation of the existing one.

For faulting or folding, the modifications may include, but are not limited to: shift, rotate, scale or deform fault; change the throws or fault type; split one fault, combine two faults, or replicate a fault to distribute the throws; shift or deform a surface, change layer thickness or lateral change rates; change the thickness between two surfaces or lateral thickness changes; or change the topology.

Unfaulting, refaulting, unfolding, and refolding can be performed with different methods depending on the desired degree of accuracy. The methods range from purely geometric methods; to kinematic methods that attempt to preserve distances, areas, and volumes; to geomechanical methods that model stresses, strains, elasticity, plasticity, failure, etc.

The operators may vary for different embodiments. For example, purely geometrical operators may suffice because similar assumptions are made for unfaulting (e.g., unfolding) and refaulting (e.g., refolding). Artifacts introduced by application of simplistic inverse operators are largely removed when applying the similarly simplistic forward operators. Because the objective of the workflow is generation of a perturbed framework, any remaining artifacts may be considered part of the perturbation.

The geometrical operators may include unfaulting geometrical operators, faulting geometrical operators, folding geometrical operators and refolding geometrical operators. The unfaulting geometrical operators may be constructed from fault-horizon-intersection polygons by estimating an intermediate polyline from the hanging- and footwall polylines. Given these three polylines and the constraint that perturbations in the far field are minimal, an operator in form of an elevation perturbation map or delta-z map can be constructed. Application of a map-based depth modification is conventional functionality in many commercially available geologic modeling packages. Removing a first of multiple faults changes the intersections between any given horizon and the remaining faults. Thus, the remaining fault-horizon-intersection polygons may need to be perturbed with the first unfaulting operator before removal of a second fault and repeated for other similar operations. Faulting geometrical operators may be constructed by specification of a throw distribution for a given fault, constructing the horizon fault-intersection polygon for the specified fault and any given horizon, constructing an elevation perturbation map conditioned on this polygon and constrained to minimize far field perturbation, and applying this perturbation map or delta-z map to the specified horizon. Folding and refolding geometrical operators may be constructed, for example, by geostatistics. Fault geometry may be changed deterministically or geostatistically.

Any other object that is specified by coordinates may also be transferred from one framework to another by application of some or all of these operators. Examples may include well picks, well paths, generic polylines, or geobodies that may be used for conditioning objects of the subsurface model. For example, perturbed horizons may be conditioned to well picks that themselves may be perturbed to account for their uncertainty. Preferably, the parameters (or geometry) of these operations is recorded to provide their application to some or all of the other objects in the model.

Each of these different aspects may be combined into a system that provides systematic examination of uncertainty by automatically perturbing selected objects of the geologic framework by selective perturbation of faults, horizons, boundaries, their topologies and their geometries.

In the present disclosure, an enhancement to exploration and reservoir delineation is described. In one or more embodiments, the method may include instantiating a realization of a subsurface model (e.g., reservoir model). The method may involve the creation of a conceptual subsurface model, the selection of parameter ranges for the various objects of the conceptual model and their interactions, and combining instantiated realizations of these objects into a subsurface model. The conceptual model may be generated by an agent (a user or a computer program that acts on behalf of a user) using a concept editor; may be automatically created from an inputted base realization; and/or may be created from the base case by systematically undoing faults and/or faults. The parameter ranges may be estimated from the undoing of faults and/or folds. Also, the unfaulting and refaulting may be performed based on fault-horizon cutoff polygons.

Further, other embodiments may include other features. For example, the instantiated realizations may be analyzed for geologic plausibility and, if warranted, rejected; may be analyzed for technical consistency and, if warranted, rejected; may be further augmented with properties such as porosity, permeability, or oil saturation; and/or may be simulated. Also, the simulation may be performed using a simulation proxy method. In addition, a set of simulations related to different scenarios and/or realizations may be summarized with a statistics and/or may be analyzed to affect a decision. A connectivity measure may be used as a simulation proxy; and this connectivity measure may be based on a graph-based centrality measure. The centrality measure, which is described in U.S. patent application Ser. No. 14/272,581, which is incorporated by reference, may include one or more of degree, betweenness, closeness, and eigenvector. Further, the method may include ranking the plurality of objects, instantiated realizations, or other items in order of the respective centralization measures.

In one or more embodiments, the method may include different concepts or a single concept. For example, the method may involve creating a concept once and multiple realizations that are created from the concept. For example, a concept may be a general layout of objects and relationships deemed to be of higher importance. The concept may not be drawn to scale, may not even show relative geometry or shape, and omit substantial amounts of detail. As another example, a realization is a model having more detail than a concept, which may be generated by a deterministic or stochastic process. The method may also include the creation of concepts that serve as scenarios. The method may also include multiple concepts that are created from multiple inputted base realizations to serve as different scenarios. Various aspects of the present techniques are described further in FIGS. 1 to 10.

FIG. 1 is a flow chart for performing hydrocarbon exploration or delineation of a potential hydrocarbon resource in accordance with an exemplary embodiment of the present techniques. The method may include creating a concept and forming various realizations based on the concept. As may be appreciated, some blocks may be omitted, repeated, performed in different order, or augmented with additional blocks not shown. That is, some blocks may be performed sequentially, while others are executed simultaneously in parallel.

This flowchart 100 begins with inputting a base realization, as shown in block 101. The base realization includes is a subsurface model having various properties. At block 102, the concept is created. The creation of the concept may include reducing the base realization to a concept by systemic removal of all deformation. The removal may include unfaulting and unfolding. In block 103, parameter ranges are selected. The selection of parameter ranges may be performed by an interpreter or computer algorithm. The selection may include determining bounds for deformations and other model parameters. Interactions between two or more of the plurality of objects may also be defined at this point in the process. Then, at block 104, the realizations are instantiated. The instantiating the realizations may include relying upon the parameter ranges (e.g., drawing parameters from these bounds) and selection of the interactions between two or more of the plurality of objects. Multiple realizations of the same concept or scenario may be obtained by systematic variation of parameters within their parameter ranges or by random sampling of the parameter ranges using a stochastic process.

As some combinations of parameters may result in realizations that are technically invalid or geologically implausible, a plausibility or validity check may be performed, as shown in block 105. In block 105, the realization is checked for technical validity and/or geologic plausibility. For example, the realization may be verified by analyzing the validity of the resulting grid or by examination of fault polygons or thickness maps. Realizations that fail this check are either modified or discarded. The verification may include determining if the realization is geologically implausible and, if so, discarding the instantiated realizations that are geologically implausible. Similarly, the verification may include determining if the realization is technically consistency and, if so, discarding the instantiated realizations that are technically inconsistency. Examples of geologically implausible realizations include those with stratigraphically older horizons conformably disposed over younger horizons, faults interpreted as belonging to a prior episode of deformation offset faults known to have moved during a later episode, and/or faults having displacement-to-map length ratios outside of bounds defined by interpretation of real faults systems. Examples of technical inconsistency include, gaps or holes in what should be continuous horizon representations, duplicated portions of horizons or faults, horizons or faults that loop back upon themselves, mesh triangles that face the wrong directions and/or grid cells that are inside-out, mesh triangles with four or more vertices, or mesh triangles that intersect each other without an explicitly represented intersection edge. After the plausibility or validity check, the realization is then populated with properties, as shown in block 106. The properties may include lithology, facies, porosity, permeability, fluid composition, and/or pressure. Once populated, the realization is simulated, as shown in block 108. The simulation of the realization may include pressure or saturation changes as functions of spatial position and time, bypassed or disconnected resources, or the fluid composition produced at a specified well.

Then, at block 109, a determination is made whether to reiterate the process for another realization. That is, the process may be repeated to instantiate other realizations. The determination may include creating a specific number of realizations, which may cover a specified part of the parameter space, cover a specified part of the response space, or design of experiments techniques to characterize the range of responses. If the determination is to perform another realization, the selection of the parameter ranges may be performed in block 103. However, if another realization is not to be performed, a set of simulations of the realization(s) is analyzed, as shown in block 110. The statistical or visual analysis may include ranking, whisper plots, box plots or other methods to review the different realizations. The analysis may include ranking the realizations based on a specified response, such as expected ultimate recovery or the maximum amount of oil, gas or water produced for a specified period of time.

Once the realizations are analyzed, the hydrocarbons are identified and produced, as shown in blocks 111 and 112. In block 111, hydrocarbons may be identified based at least partially on the analysis of the realizations. As an example, the realizations may be integrated with other measured data or subsurface models of the subsurface regions below the survey region. These different types of data may be integrated based on location information associated with the respective data to lessen uncertainty associated with the existence of hydrocarbons. Finally, the identified hydrocarbons may be produced, as shown in block 112. With the identification of hydrocarbons, various production operations may be performed to produce the hydrocarbons. For example, the operations may include drilling of a well to provide access to the hydrocarbon accumulation. Further, the production may include installing a production facility configured to monitor and produce hydrocarbons from the production intervals that provide access to the hydrocarbons in the subsurface formation. The production facility may include one or more units to process and manage the flow of production fluids, such as hydrocarbons and/or water, from the formation. The production equipment and operations may be based on the realizations. To access the production intervals, the production facility may be coupled to a tree and various control valves via a control umbilical, production tubing for passing fluids from the tree to the production facility, control tubing for hydraulic or electrical devices, and a control cable for communicating with other devices within the wellbore.

Beneficially, by using a concept, the present techniques provide a mechanism to provide a master subsurface model that may be used to generate other subsurface models. As noted above (e.g., in block 104), the present techniques involves generating perturbations from the concept to form various realizations. Then, the present techniques involve verification of the realizations (e.g., that the realizations are proper models). This provides a mechanism to lessen contamination by implausible models during subsequent statistical analysis.

For the purpose of the present disclosure, the geologic model may be divided into a framework and content. The framework is formed by collections of volumes (three-dimensional), their bounding surfaces as well as other surfaces (two-dimensional), polylines or curves (one-dimensional), and points (zero dimensional) that are embedded in a three-dimensional space. Surfaces relate to an area of interest, faults, and horizons. Curves relate to surface intersections, such as fault-horizon intersections, fault sticks, or polygons and polylines, separating gross geologic features, such as environments of deposition. Horizons partition the model into zones; while faults partition the model into segments. Faults, horizons, and polygons partition the model into compartments.

Content refers to the properties associated with compartments (e.g., three dimensional distribution of properties), surfaces (e.g., two-dimensional distribution of properties), and polylines (e.g., one-dimensional distribution of properties). A distinction between content and framework is the existence of a mesh or grid used to discretize properties.

Figure 2:
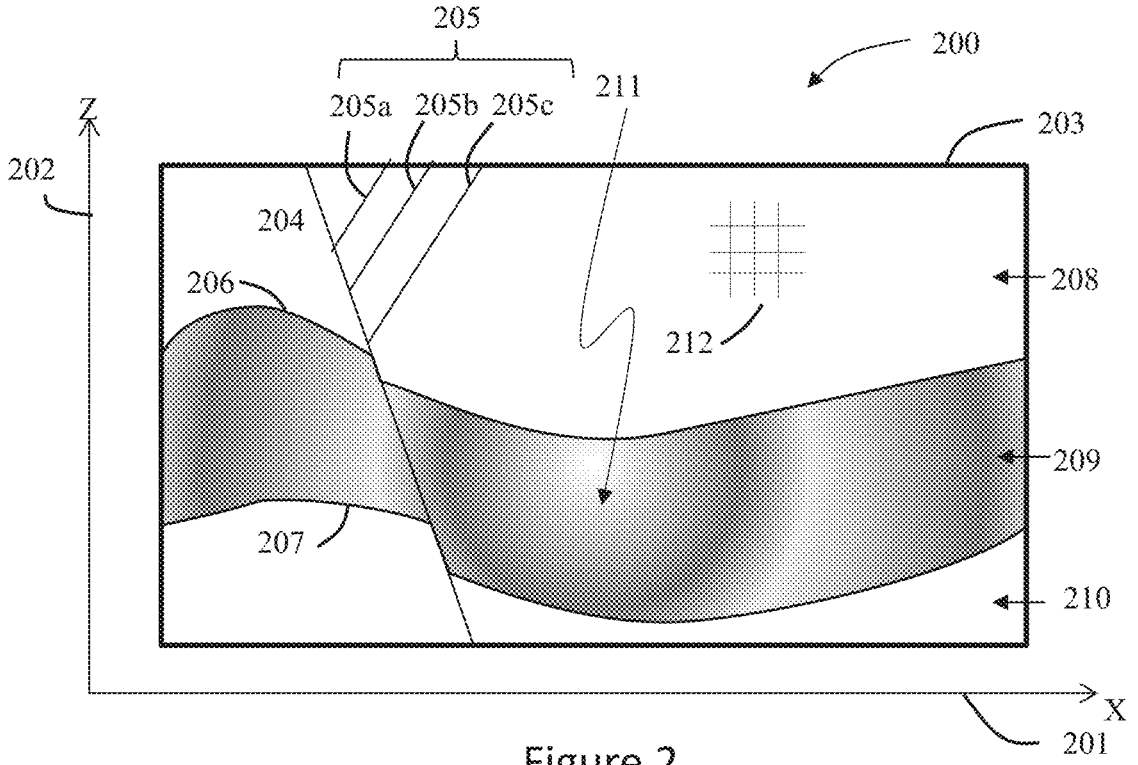
FIG. 2 is a diagram of a realization of a geologic model.
Figure 3:
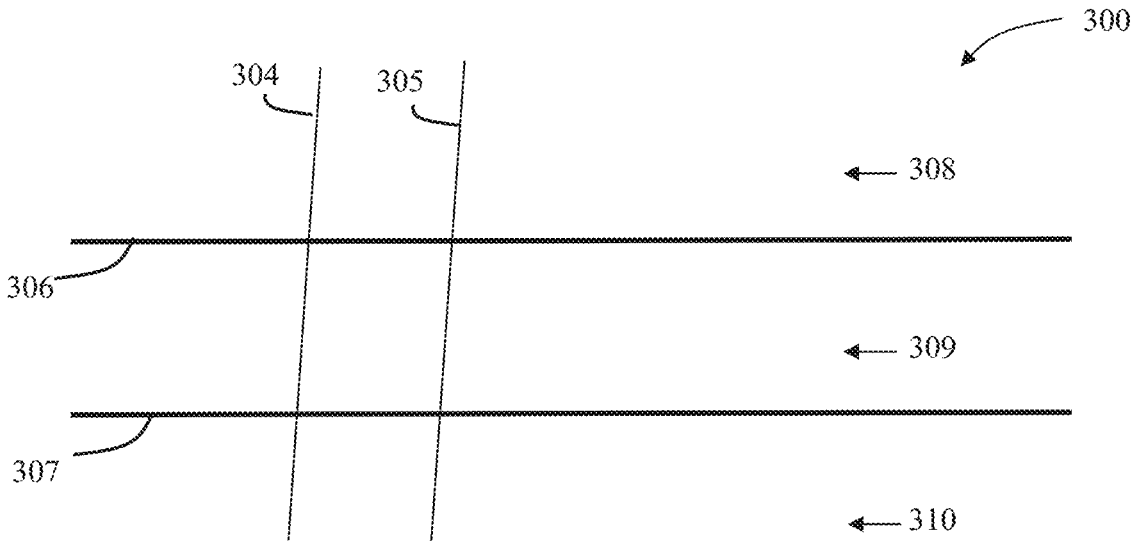
FIG. 3 is a diagram of a concept of the realization of FIG. 2.

As noted above, concepts and realizations relate to different aspects, which are further explained in FIG. 2 and FIG. 3. These representations exemplify some of the differences between a realization, as shown in FIG. 2, and a concept, as shown in FIG. 3.

FIG. 2 is a diagram of a realization 200 of a geologic model. A realization 200 includes a frame of reference or coordinate system, as indicated by the coordinate axes 201 and 202. The realization 200 has an area of interest or region of interest 203 that specifies the spatial extent of the model. Inside this region of interest 203, the realization 200 is completely quantified to enable numerical simulations. Outside this region of interest 203, the realization 200 is not specified and/or quantified. There may or may not be any data or information available about the region outside of the region of interest 203; but the region outside of the region of interest 203 is irrelevant because it is not modeled. In this diagram, the realization 200 includes faults 204 and 205 (e.g., faults 205*a*, 205*b*, and 205*c*). In realization 200, there is a crosscutting relationship between the two faults, where fault 204 is dominant or major as compared to fault 205. The minor fault 205 is realized by a set of parallel faults 205*a*, 205*b*, and 205*c*.

The realization 200 also includes horizons 206 and 207. Both realized horizons 206 and 207 have attached geometries that describe depth, shape, and displacement caused by fault 204. The horizons 206 and 207 create various zones, such as zones 208, 209, and 210, which are bound by either the area of interest 203 or the horizons 206 or 207. In realization 200, surfaces and zones, such as zones 208, 209, and 210, may have attached properties. For example, zone 209 has an attached property 211 indicated by the gradual shading, such as porosity, net-to-gross ratio, or hydrocarbon saturation. The realized properties may be specified on a grid or mesh, such as mesh 212. The realization contains the necessary information to perform a specified computation or simulation, such as the estimation of the gross rock volume (GRV), the stock tank original oil in place (STOOIP), the expected ultimate recovery (EUR) or the prediction of water cuts.

Unlike the realization 200, a concept 300 does not need a frame of reference and/or a region of interest. For example, FIG. 2 is a diagram of a concept 300 of the realization 200 of FIG. 2. The concept 300 includes faults 304 and 305, horizons 306 and 307, and zones 308, 309 and 310. Because geometry in a concept 300 is typically unspecified, no frame of reference is utilized and horizons and faults are indicated by lines or planes, as shown by faults 304 and 305 and horizons 306 and 307. In this diagram, fault 304 appears to be to the left of fault 305, but without geometry, the spatial arrangement of the faults cannot be specified. If desired, constraints on the spatial arrangement may subsequently be imposed with the selection of parameter ranges, as noted in block 103 of FIG. 1. Also, horizon 306 appears to overlay horizon 307, but again, without geometry, the spatial arrangement of the horizons cannot be specified. If desired, constraints on the spatial arrangement may subsequently be imposed with the selection of parameter ranges in block 103 of FIG. 1. Preferably, however, the topology is augmented with the concepts of younger (shallower) and older (deeper) to capture the relative order of horizons in the conceptual model. Horizons 306 and 307 are preferably typed as 'base', 'top' or 'erosional', 'conformable', or 'unconformable' or 'discontinuous'. With a relative order established between horizons 306 and 307, units or zones 308, 309 and 310 can be defined. Zone 309 is bound, capped by horizon 306, and based by horizon 307. Zone 308 is unbound and based by horizon 306. Zone 310 is unbound and capped by horizon 307. Faults 304 and 305 are preferably typed as 'normal', 'reverse', or 'strike-slip'. Preferably, conceptual faults are further attributed with attributes such as 'major' or 'minor'. If fault 304 is attributed with 'major' while fault 305 is attributed 'minor', then a realization of 304 truncates a realization of fault 305 in the event they intersect.

The comparison of these diagrams exemplifies some of the differences between a realization and a concept. For example, the conceptual faults 304 and 305 are realized as faults 204 and 205 (e.g., faults 205*a*, 205*b*, and 205*c*). In the realization 200, there is a crosscutting relationship between the two faults where 204 is dominant or major, while, in the concept 300, both faults 304 and 305 are typed 'normal'. Also, conceptual horizons 306 and 307 are realized as horizons 206 and 207. Both realized horizons, such as horizons 206 and 207, have attached geometries that describe depth, shape, and displacement caused by fault 204, while the conceptual horizons do not have such properties. Further, zones 208, 209, and 210 are bound by either the area of interest 203 or the horizons 206 or 207. In realization 200, surfaces and zones may have attached properties, while the conceptual zones do not include properties.

Again, the geologic model may be divided into a framework and content. Thus, the process of instantiating a realization is separated into two steps, which are i) instantiation of a framework realization and ii) instantiation of property realizations.

As noted above, the present techniques involve the concept creation (e.g., blocks 101 and 102 of FIG. 1) and instantiation of framework realizations (e.g., blocks 103 and 104). In some embodiments, the concept is created directly with a suitable tool. Preferably, however, the concept is created from a base realization (e.g., a realized geologic model that is stripped of geometry and possibly parts of its topology, meaning, and interpretation). Preferably, this base realization is the most likely reservoir model, a model synthesized from the optimal interpretation, or the model is the statistically centralized (e.g., in the middle of the groupings) with regard to a specified prediction. Concept creation by removal of geometry can be seen as the process of systematic undeformation (e.g., unfaulting and unfolding). Unfaulting and (re)faulting are discontinuous deformations, while unfolding and (re)folding are continuous deformations. Instantiating a realization by attaching geometry may be the process of systematic deformation (e.g., refaulting and refolding).

As noted above, unfaulting F−1, refaulting F, unfolding S−1, and refolding S can be viewed as mappings, transforms, or operators. If the method is performed with the refaulting operator being the inverse of the unfaulting operator (e.g., F−1*F=F*F−1=1) and the refolding operator being the inverse of the unfolding operator (e.g., S−1*S=S*S−1=1), then the resulting framework realization may be substantially identical to the existing base framework. However, if the refolding operator and/or the refaulting operator are modified, then the resulting framework realization may be a perturbation of the base framework.

Figure 4:
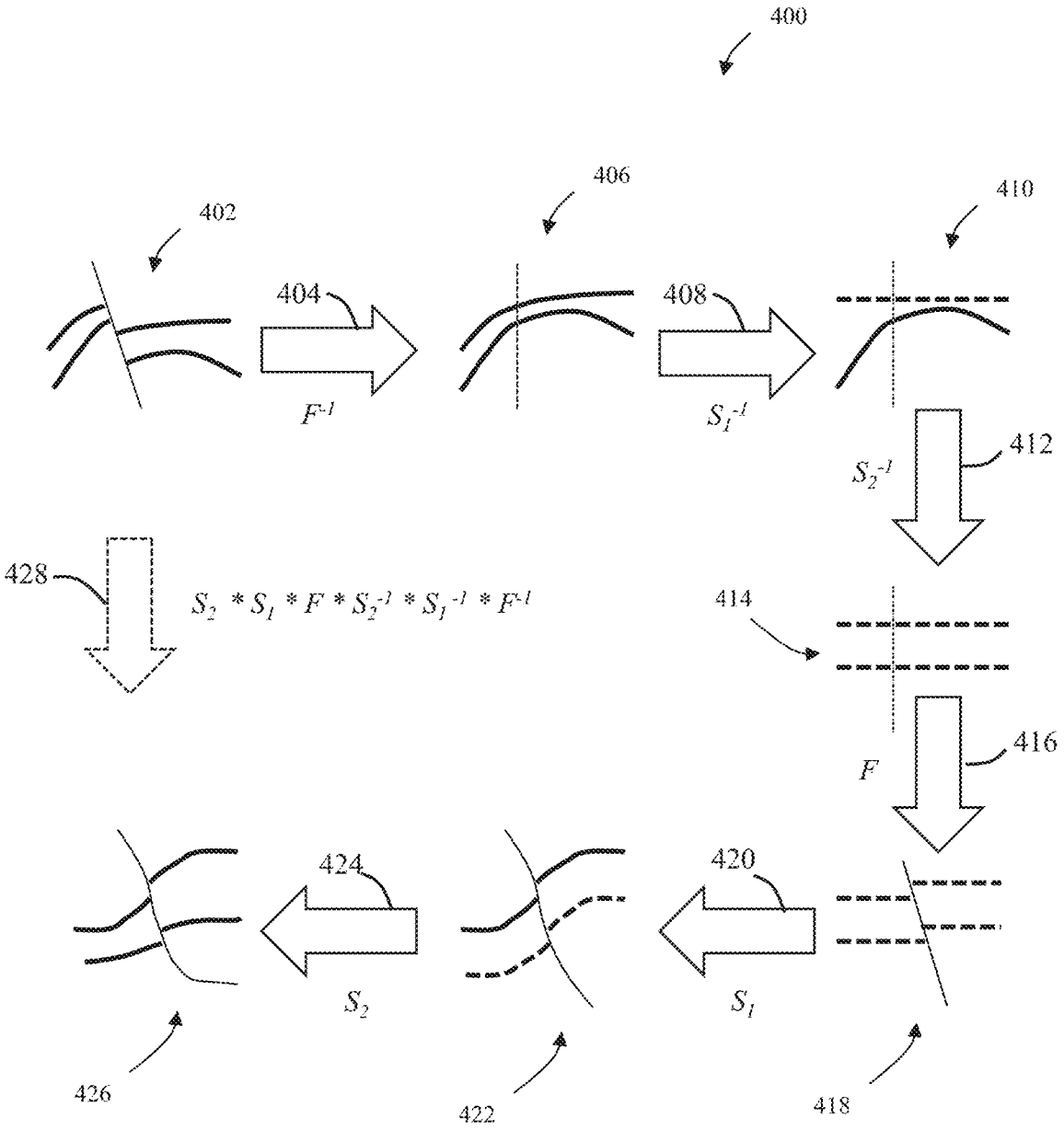
FIG. 4 is a diagram of a schematic application of the undeforming and redeforming a framework in accordance with an exemplary embodiment of the present techniques.

FIG. 4 is a diagram 400 of a schematic application of the undeforming and redeforming a framework in accordance with an exemplary embodiment of the present techniques. In this diagram 400, the one (re)faulting operator and two (re)folding operators are utilized. The operators are perturbed, and their sequential order is commuted to create a realization caused by a different sequence of deformation events. Solid curves denote instantiated or realized objects, while dashed curves indicate conceptual objects. Block 402 depicts the base realization. Block 404 is the unfaulting operation F−1 that removes the discontinuities imposed by the fault from the horizons and renders the fault conceptual. The result of this operation is shown in block 406. Block 408 is a first unfolding operation S1−1 that removes the effect of one regional deformation and renders one horizon conceptual. The result of this operation is shown in block 410. Block 412 is a second unfolding operation S2−1 that removes the effect of another regional deformation and renders the second horizon conceptual. Block 414 depicts the resulting conceptual model. Instantiating one realization, as shown in block 426, begins with block 416, the application of the faulting operator F that instantiates a different type of fault, a reverse fault. The result of this operation is shown in block 418. A first refolding operator, as shown in block 420, deforms both the already realized fault and instantiates a first horizon. The result of this operation is shown in block 422. The second refolding operator, as shown in block 424, deforms both the realized fault and horizon and instantiates the second horizon. The result of this operation is shown in block 426, which is the instantiated realization. This sequence of operators, as shown in block 428, transformed the base realization 402 to another realization 426. Unfaulting, refaulting, unfolding, and refolding can be performed with different methods depending on the desired degree of accuracy. The methods range from purely geometric methods; to kinematic methods that attempt to preserve distances, areas, and volumes; and to geomechanical methods that model stresses, strains, elasticity, plasticity, failure, etc.

For faulting, the modifications include but are not limited to: shift, rotate, scale or deform a fault; change the throws; change the fault type; split one fault into a set of parallel or echelon faults; combine multiple faults into one; or change the topology or interaction between faults. For folding, the modifications include but are not limited to: shift or deform a horizon; change zone thickness or lateral change rates; change the horizon type; or change the topology or interaction between horizons. Polylines may be shifted, scaled, or deformed. Those skilled in the art should recognize that the abovementioned lists of modifications are only meant to be exemplary and not meant to be exhaustive.

As a specific example, returning to FIG. 1, at block 101, a base realization is inputted into the system that is systematically converted to a concept in block 102 by stripping properties and geometries from the base realization using a sequence of unfaulting and unfolding operations. Preferably, at least some aspects of the stripped geometries and properties are retained to aid the selection of a parameter ranges in block 103. In block 103, an agent (e.g., a user and/or a computer program that acts on behalf of a user) selects a set of at least one modification from the exemplary set of modifications and specifies parameters for these modifications. A fault may be parameterized by its base location, its base shape, a perturbation of its base shape, a scale to increase or reduce its extent, and a throw profile. Other parameters may include type and its position within the deformation sequence. A horizon may be parameterized by its base location, its base shape, a perturbation of its base shape, a type and its positions within the stratigraphic sequence and deformation sequence. A polygon may be parameterized by its base location, its base shape, a perturbation of its base shape, a scale, a shift, or the zone(s) to which it is applied to impart an environment of deposition specified by an agent.

Analogous to using undeformation operators to convert a base realization to a concept, deformation operators are used to instantiate a realization of the concept in block 104. This may involve an agent specifying a sequence of continuous (e.g., refolding) and discontinuous (e.g., refaulting) deformations. The agent parameterizes the individual deformations and applies them to the concept objects of faults, horizons, and polylines. The realized faults and horizons may not intersect and truncate each other correctly. For example, horizons may need to be clipped or extended to the faults, while other horizons may need to clipped or extended to other horizons. Further, some faults may need to be clipped or extended to other faults. It may also be advantageous to determine the intersection curves between faults and/or horizons and assign these curves to the geometries of the intersecting objects (e.g., by using known processes, such as the creation of a watertight framework). Methods for clipping and extending objects and the subsequent creation of a watertight framework are known to those skilled in the art. For example, one such disclosure is U.S. Pat. No. 7,756,694.

The instantiated framework realization may then be converted into a three-dimensional grid bound by the area of interest. Details of the gridding process are known to those skilled in the art. Examples may include U.S. Patent Application Publication Nos. 2013/218539 and 2012/265510 along with U.S. Pat. No. 7,248,259.

Based on the automatic instantiation of a framework realization in block 104 and the succeeding grid realization, the framework and/or the grid may be geologically implausible and/or technically invalid. Block 105 checks the geologic plausibility and technical validity of the instantiated realization. If the framework is found invalid or implausible, this framework realization is removed from the workflow and/or at least flagged. Judicious parameterization and narrow parameter ranges may limit the instantiation of unacceptable realizations. A tradeoff, however, exists between plausibility/validity and variety of realization. Narrow ranges may yield little variety between realizations, but a greater number of plausible or valid ones. In some embodiments, parameters for the individual deformations are drawn independently for efficiency, but the resulting interaction of deformations may be far-fetched. An example of implausible realizations is shown below in FIGS. 5A, 5B and 5C.

Figure 5A:
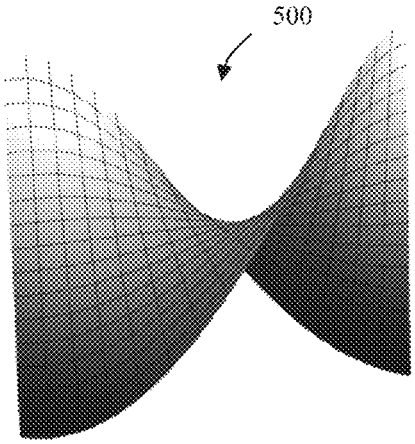
FIGS. 5A, 5B and 5C are diagrams of implausible realizations.
Figure 5B:
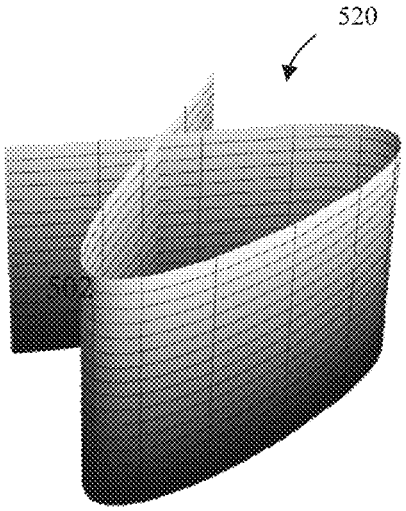
Figure 5C:
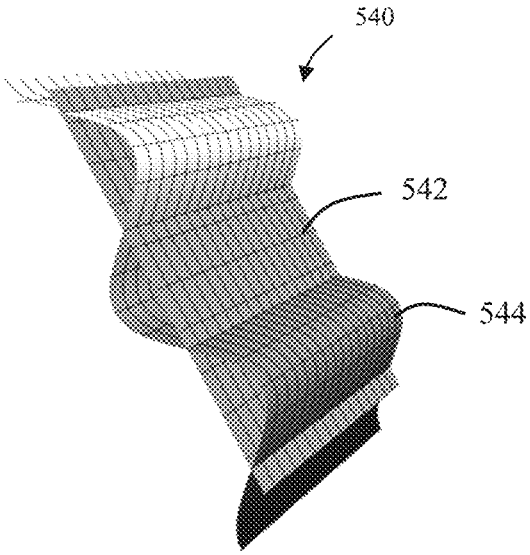

FIGS. 5A, 5B and 5C are diagrams of implausible realizations 500, 520 and 540. These realizations 500, 520 and 540 involve two faults cut through each other multiple times or one fault cuts itself. Realization 500 changes polarity by slowly turning upside down. Realization 520 intersects itself and realization 540 contains two faults 542 and 544 that intersect each other multiple times.

Technical validity refers to the ability to create a mesh or grid associated with the instantiated framework realization. Some realizations may simply violate assumptions made by the gridding algorithm leading to an abnormal termination of the gridding process. In the worst case, the gridding algorithm may even crash. Other realizations may stretch the gridding algorithm beyond its design specifications, causing the generation of poor grids with a large number of cells with high aspect ratios, highly obtuse angles, or negative areas and volumes. Analysis of the grid generation process and the resulting grid realization provides a mechanism for removal or at least flagging of invalid realizations from the remainder of the process.

Typically after attaching a grid to the framework realization, properties are instantiated, which is shown in block 106. The realization is populated with properties such as porosity, net-to-gross ratio; oil, gas and water saturations, and horizontal and vertical permeabilities. The properties can be assigned deterministically, geostatistically, or by simulation; and conditioned or unconditioned with regard to other data, such as well logs or seismic data. Methods for instantiating properties in geologic models are known to those skilled in the art. An example is U.S. Pat. No. 7,415,401 to Calvert et al. entitled "Method for constructing 3-D geologic models by combining multiple frequency passbands".

Preferably, properties (e.g., within the model) are conditioned, as shown in block 107. The property or data may be conditioned or at least guided by well markers, well logs, maps, or seismic horizon attributes and seismic volume attributes. All of these conditioning data have geometry, but the present techniques create realizations of geologic models by perturbing, distorting, or modifying geometry. In some embodiments, it may be advantageous to modify the geometry of the conditioning data in the same manner by application of the same sequence of undeformations and redeformations used to create the concept and instantiate the realization. Some preferred embodiments may involve modifying the geometry of the conditioning data in an approximately similar manner only to allow for geometric uncertainty in these data caused by data acquisition, data processing, or interpretation. In one embodiment, some and/or all of the operators in the sequence may be modified or perturbed when applied to conditioning data. In a preferred embodiment, some additional operators are attached to the operator sequence for the conditioning data to model the geometric uncertainty of the conditioning data. Further, the conditioning of the properties may include using undeformation and redeformations on the data to be used in the conditioning.

The instantiated realization may then be simulated in block 108 and/or analyzed in block 110 to predict a specified quantity. Some predictions can be made directly from the subsurface model. Examples include but are not limited to gross rock volume (GRV), the stock tank original oil in place (STOOIP), or the expected ultimate recovery (EUR). Other predictions may involve additional financial assumption to calculate cash flow, discounted cash flow (DCF), discounted cash flow rate (DCFR), net present value (NPV), or return on capital employed (ROCE). Performing a reservoir simulation in block 108 provides a prediction of water cuts, flow streams, flow capacity, storage capacity, connectivity, or some other performance indicator.

Instead of computing a complete fluid-flow simulation based on full-physics models that include state equations for oil, gas and water, multiphase Navier-Stokes equations, and a complete development/production scenario with producer wells, injector wells, injection rates, and perforation zones, it may be advantageous to use reduced-order or reduced-physics model, also termed a proxy model, to achieve computational efficiency and to reduce complexity by suppressing needless detail. Examples of such proxy simulations may be European Patent No. 1,994,488; U.S. Pat. No. 8,437,997 to Meurer et al entitled 'Dynamic Connectivity Analysis', U.S. Pat. No. 7,164,990 to Bratvedt et al entitled 'Method Of Determining Fluid Flow', or Hirsch and Schuette, 'Graph Theory Applications To Continuity And Ranking In Geologic Models', Computers & Geosciences, 25(2), 127-139, 1999.

Once realized and possibly simulated, the analysis of the realization and/or the analysis of its simulation results may be performed, as noted in block 110. Preferably, multiple realizations are instantiated and simulated and included as part of the analysis.

In certain embodiments, blocks 101 to 103 may be performed in an initial stage to convert the base realization to the concept with specified parameter ranges, while blocks 104 to 108 may be repeated through multiple iterations (e.g., multiple times or stages) to generate multiple realizations and/or simulations for analysis. The number of repetitions may be controlled by the user or an agent directly by specification or indirectly by selection of a stopping criterion to ensure an appropriate sampling of the parameter space.

Often, predictions may exhibit transitions between different behaviors where perturbing parameters up to a certain point yields similar results, but perturbing the parameters beyond this point yields a very different result (e.g., different regimes). This behavior may be likened to phase transitions in thermodynamic systems where the system can abruptly move to a different state with very different properties. In one preferred embodiment, the stopping criterion attempts to predict the number of 'states' and locate the transitions between the discovered states in the parameter space. For example, the different regimes may involve predictions that impact the flow within the reservoir compartments and/or well. In particular, different regimes may include changes in flow that divide different compartments to adjust the amount of fluid communication between the compartments.

In yet other embodiments, it may also be advantageous to input not only one base realization into the process of blocks 101 to 108, but to iterate over multiple base realizations. Each base realization corresponds to a different scenario. A scenario is an alternative working hypothesis; or in the context of this disclosure, a scenario is an alternative concept. The workflow uses at least one concept that in a preferred embodiment is generated from a base realization. Preferably, however, multiple base realizations may be reduced to multiple concepts that differ from each other. Each of these different concepts may represent a different scenario.

The analysis or simulation of multiple realizations of one or multiple scenarios creates large amounts of data that may be visualized or summarized. In one embodiment, realizations are compared against each other by use of a metric that is used to group or cluster similar realizations (e.g., Suzuki et al, 'Dynamic data integration for structural modeling: model screening approach using a distance-based model parameterization', Computational Geosciences, 105-109, 2008). Techniques such as multi-dimensional scaling (MDS) may be used to group or cluster realizations and predictions.

Reservoir simulation can create large amounts of time-dependent results or time-series data. In one embodiment, these time-series data are presented as contour boxplots (e.g., Sun and Genton, 'Functional Boxplots', Journal of Computational and Graphical Statistics, 20(2), 316-334, 2011).

In another embodiment, the inputting of base realization(s) in block 101 may be omitted. Instead of concept creation by conversion of inputted base realizations by systematic removal of deformation (unfaulting and unfolding), a user or agent may input or create at least one concept directly, for example, by using a concept editor in block 102. A concept editor provides a mechanism for the creation of conceptual models by specifying at least the number of horizons, faults, and polylines. Preferably, the concept editor may be used to specify certain attributes, such as fault type, horizon type, environment of depositions, and their interactions. In a preferred embodiment, the concept editor creates objects for the specified entities directly in a geologic modeling software package where they can be operated on with a sequence of deformation operators F and S. In another embodiment, the concept editor creates objects for the specified entities either in memory, a file system, or in the cloud from where they can be imported by a geologic modeling software package to be operated on with a sequence of deformation operators F and S.

Figure 6A:
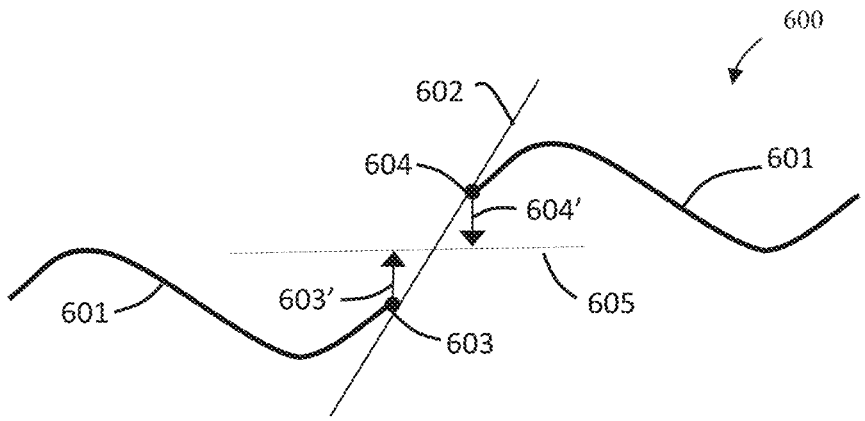
FIGS. 6A, 6B and 6C are diagrams of unfaulting during concept creation.
Figure 6B:
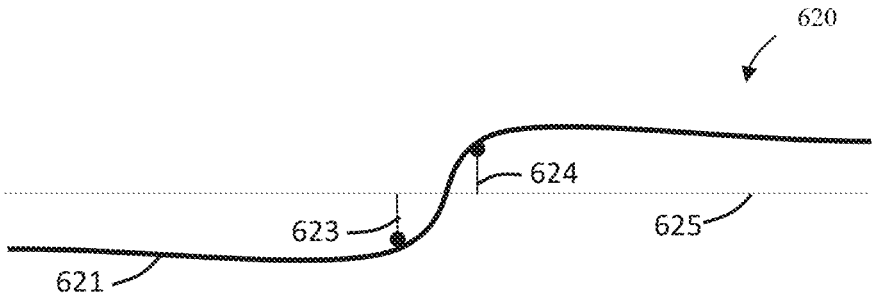
Figure 6C:
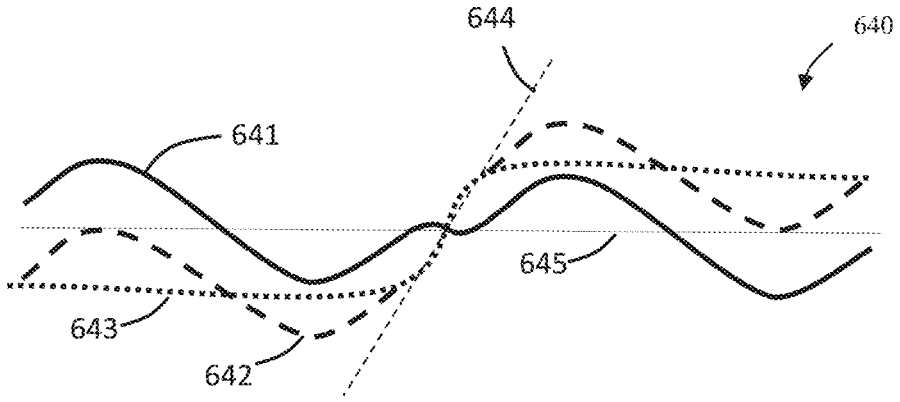

A preferred method of unfaulting is presented in FIG. 6. FIGS. 6A, 6B and 6C are diagrams 600, 620 and 640 of unfaulting during concept creation. The concept creation may be performed in block 102 of FIG. 1. FIG. 6A is a diagram 600 having a horizon 601 that is bisected by normal fault 602 resulting in the foot-wall truncation 604 and hanging-wall truncation 603. The truncations 604 and 603 are preferably represented as polylines forming a cutoff polygon for horizon 601 against fault 602. A reference, such as reference line 605, is created from the foot-wall and hanging-wall polylines. One method for creating the reference is simply to average the depths or two-way travel times of the cutoff polygon. Preferably, a local or floating reference is created for every polygon point. For a specified point of the foot-wall polyline, the laterally nearest point (e.g., neglecting vertical offset) of the hanging-wall polyline is determined and the local reference for the specified point is determined by averaging its depth with the depth of the nearest point on the hanging-wall polyline. For a specified point of the hanging-wall polyline, the laterally nearest point (e.g., neglecting vertical offset) of the foot-wall polyline is determined and the local reference for the specified point is determined by averaging its depth with the depth of the nearest point on the foot-wall polyline. The dynamic-time-warping (DTW) algorithm may be an efficient method to determine corresponding points on foot-wall and hanging-wall polylines. The residual polygon consisting of residual polylines 603' and 604' is created by subtraction of the reference 605 from the cutoff polygon formed by polylines 603 and 604.

FIG. 6B is a diagram 620 having an unfaulting map or correction map 621 that is formed from the residual polylines 623 (corresponding to 603' of FIG. 6A) and 624 (corresponding to 604'). Preferably, the map is formed by extrapolation from the residual polylines 623 and 624. Preferably, the extrapolation converges toward the level of zero, as shown by reference line 625 (corresponding to 605), at distance from the specified residual polylines. The extrapolator may involve regularization or other forms of extrapolation constraints. Minimal curvature may be a preferred regularization method.

FIG. 6C is a diagram 640 having an unfaulted horizon 641 that is formed by subtracting the map 643 (corresponding 621 of FIG. 6B) from the horizon 642 (corresponding to 601 of FIG. 6A). The reference or level of zero is shown by reference line 645. The effect of fault 644 is removed from horizon 641. Fault 644 has been reduced to a concept as indicated by the dashes. The unfaulted horizon may contain gaps or artifacts that are preferably removed by filtering and interpolation.

When the base realization contains more than one fault, then removal of the first fault changes the horizon(s) and thus the cutoff polygon(s) for the remaining fault(s). Either the fault cutoffs should be recreated, or preferably, the original cutoff polygons may be corrected by subtraction of the correction map. For example, if the base realization contains three faults, then removal of the first fault triggers the correction of the cutoff polygons around the second and third faults. Subsequent removal of the second fault triggers another correction of the cutoff polygon around the third fault. Subsequent removal of the third fault does not trigger any further corrections because the all faults are reduced to concepts.

Realizing a fault has two aspects: (i) the specification of all its parameters and (ii) the redeformation of the other objects in the model. For computational efficiency, it may be advantageous to create an explicit fault object between the first and the second aspects.

Figure 7A:
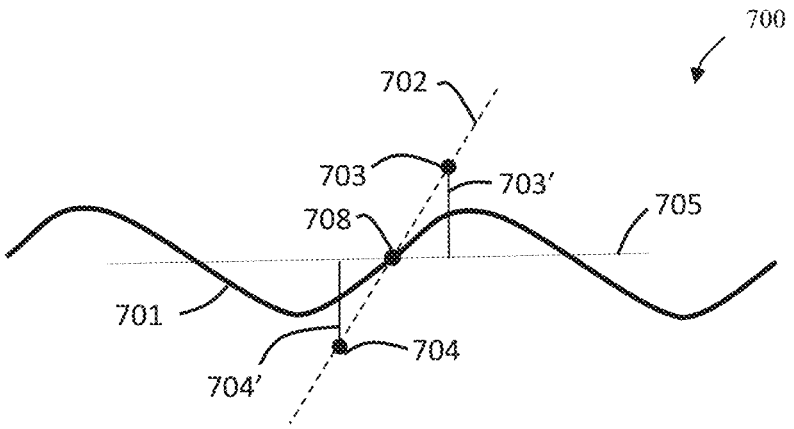
FIGS. 7A, 7B and 7C are diagrams of refaulting during instantiation of a realization.
Figure 7B:
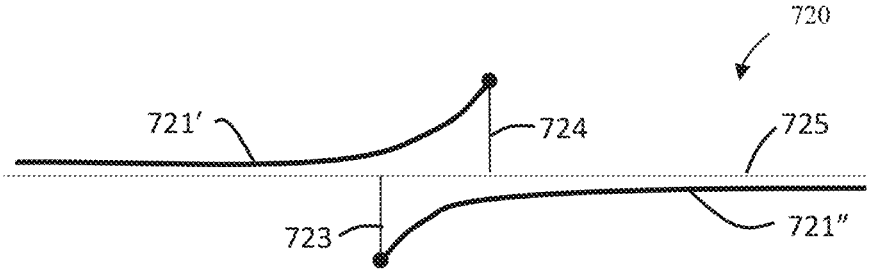
Figure 7C:
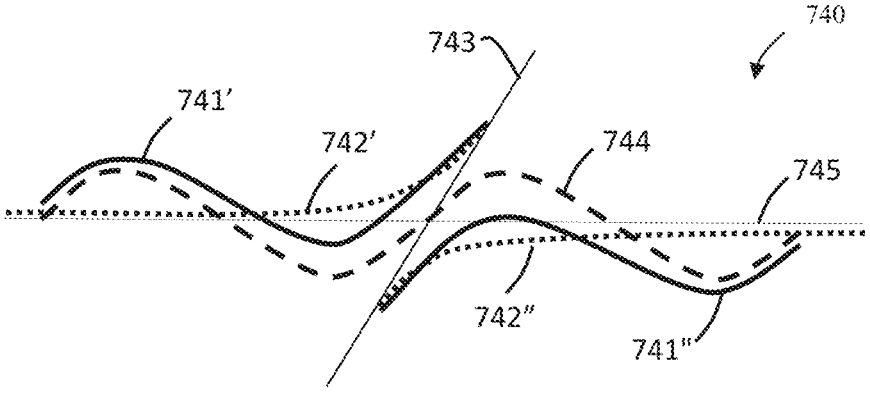

A preferred method of refaulting is presented in FIGS. 7A, 7B and 7C. FIGS. 7A, 7B and 7C are diagrams 700, 720 and 740 of refaulting during the instantiation of a realization. The instance realization may be performed in block 104 of FIG. 1. FIG. 7A is a diagram 700 having a conceptual reverse fault 702 indicated by dashes that bisects horizon 701. The process begins with parameterizing the fault 702 by specification of the fault geometry (e.g., location, orientation, shape, size, etc.). Some of these geometry parameters may be prescribed by the parameter ranges specified in block 103 of FIG. 1, while others may be drawn at random from statistical distribution functions specified in block 103 of FIG. 1. In another embodiment, combinations of parameters may be selected by systematic sampling of the parameter ranges. A fault throw is also specified, for example at the intersection 708 of the realized fault with the horizon or preferably for every location on the fault by designating fault throw as a property attached to the fault. The fault-horizon intersection 708 is also used to define the local reference depth 705. Fault type, reference, and throw are used to define the cutoff polygon consisting of foot-wall polyline 704 and hanging-wall polyline 703. For a reverse fault, the foot-wall polyline 704 is determined by shifting the fault-horizon intersection 708 downwards along the realized fault 702 by half the local throw, while the hanging-wall polyline 703 is determined by shifting the fault-horizon intersection 708 upwards along the realized fault 702 by half the local throw. For a normal fault, foot-wall and hanging-wall polylines are swapped: the foot-wall polyline 704 is determined by shifting the fault-horizon intersection 708 upwards along the realized fault 702 by half the local throw, while the hanging-wall polyline 703 is determined by shifting the fault-horizon intersection 708 downwards along the realized fault 702 by half the local throw. In a preferred embodiment, the polylines 703 and 704 are found by vertical shifting only of 708, neglecting any lateral component introduced by shifting along the fault surface itself. The residual polylines 703' and 704' are determined from the polylines 703 and 704 by subtraction of the reference 705.

FIG. 7B is a diagram 720 having a refaulting map or correction map 721 (consisting of 721' and 721") that is formed from the residual polylines 723 (corresponding to 704' of FIG. 7A) and 724 (corresponding to 703' of FIG. 7A). Preferably, the map is formed by extrapolation from the residual polylines 723 and 724. Preferably, the extrapolation converges toward the level of zero 725 at distance from the specified residual polylines. The extrapolator may require regularization or another form of extrapolation constraint. Minimal curvature is a preferred regularization.

Under the process of normal faulting, a flat, single-valued horizon remains single valued; and the correction map 721 can be extrapolated from 723 and 724 directly without invoking 721' and 721". Under the process of reverse faulting, however, a flat, single-valued horizon will become multi valued. In the region between the foot-wall cutoff and the hanging-wall cutoff, the horizon will be duplicated and overlapping itself. Thus for a reverse fault, the refaulting map is multi valued between the foot-wall and the hanging-wall cutoffs shifting the meaning of map from a two-dimensional depiction of residual elevation toward a mathematical operator or transform. It may be advantageous to divide the multi-valued map 721 into the single-valued maps 721' and 721".

FIG. 7C is a diagram 740 having a refaulted horizon 741 consisting of 741' and 741" that is formed by adding the map 742 consisting of 742' (corresponding to 721' of FIG. 7B) and 742" (corresponding 721" of FIG. 7B) to the horizon 744 (corresponding to 701 of FIG. 7A), while providing multivaluedness or overlap in horizon 741 by use of an appropriate representation. The effect of fault 743 is thus imparted onto horizon 741. Fault 743 has been realized from a concept as indicated by the solid line. The reference or level of zero may be shown by reference line 745. For refaulting with a reverse fault, the unfaulted (conceptual) horizon piece inside the cutoff polygon is used twice as it gets added both to 742' and to 742". For refaulting a horizon with a normal fault, the unfaulted (conceptual) horizon piece inside the cutoff polygon would not be used at all. In either case, the refaulted horizon 741 may contain gaps or artifacts that are preferably removed by filtering and interpolation. Preferably, a process, such as disclosed in U.S. Pat. No. 7,756,694, is used to clean up the fault-horizon intersection by extrapolation of the horizon to the fault, cutback and truncation of the horizon by the fault, and creation of a watertight intersection. Preferably, the process may also be used to clean up fault-fault or horizon-horizon intersections and to create cutoff polygons.

When the concept contains more than one fault, then realization of the first fault changes the horizon(s) and thus the intersections with the remaining fault(s). Either the original cutoff polygons (intersections between fault and horizon, e.g., fault-horizon intersection 708) are corrected by addition of the correction map, or preferably, cutoffs at the remaining faults are recreated. For example, if the concept contains three faults, then realization of the first fault triggers the correction of the cutoff polygons around the second and third faults. Subsequent realization of the second fault triggers another correction of the cutoff polygon around the third fault. Subsequent realization of the third fault does not trigger any further corrections because the all faults have been realized. In some embodiments, the map (e.g., map 742) is added only to the horizon (e.g., horizon 744), while in others the map is also added to some or all of the faults that are already realized to preserve their relative positions during the refaulting operation.

Figure 8:
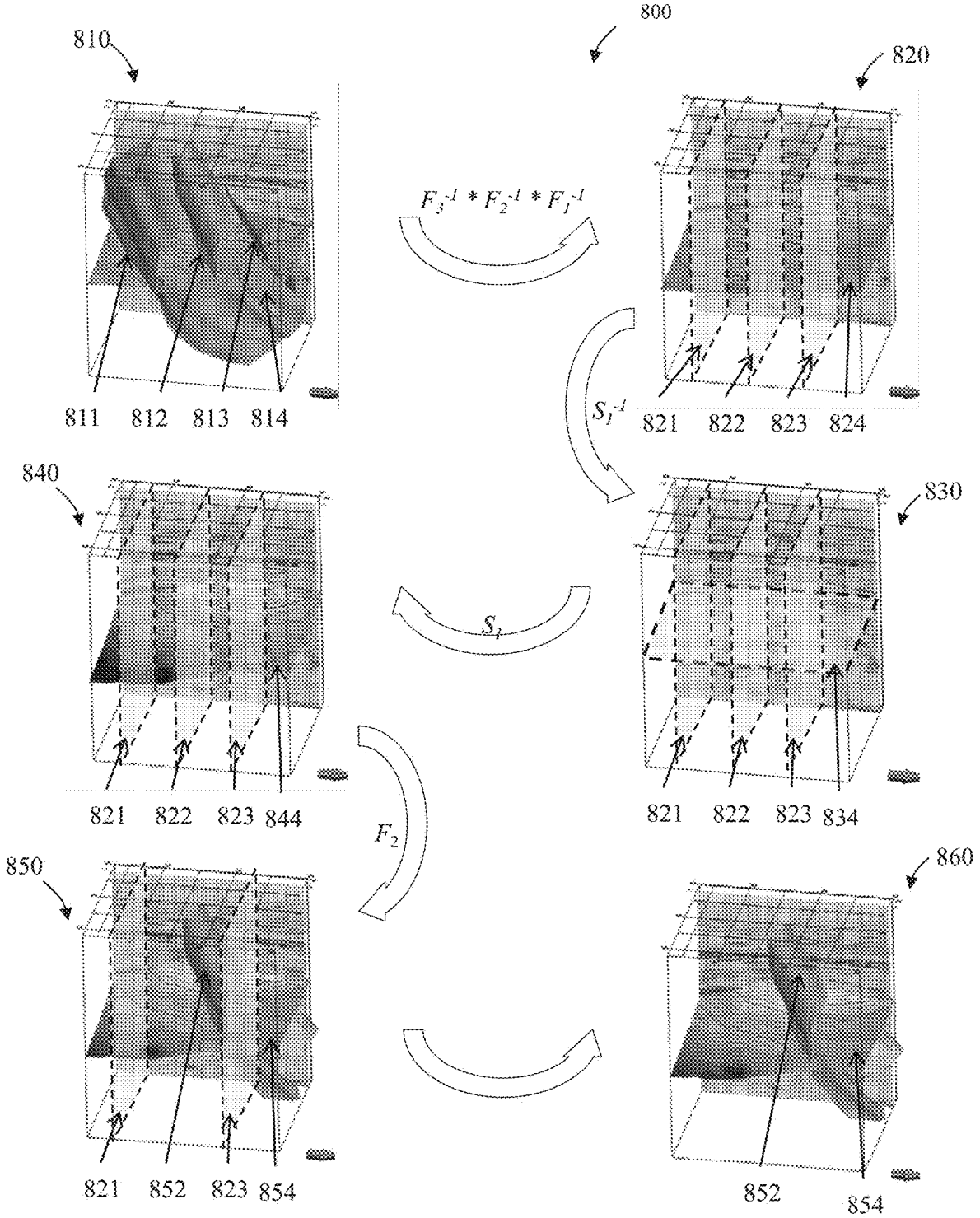
FIG. 8 is a diagram of the process from a base framework realization to an instantiated framework realization in accordance with an exemplary embodiment of the present technique.

FIG. 8 is a diagram 800 of the process from a base framework realization to an instantiated framework realization in accordance with an exemplary embodiment of the present techniques. Diagram 800 presents an exemplary application of the workflow from a base framework realization, such as base framework realization 810, to an instantiated framework realization, such as instantiated framework realization 860.

The process begins with the base framework realization 810. The base framework realization 810 includes three faults 811, 812, and 813 and one horizon 814. First, the three faults are converted to conceptual faults by removing their geometry and healing their effects on the horizon 814. This may be performed by applying the unfaulting operators, such as first unfaulting operator F1−1 for the first fault 811, second unfaulting operator F2−1 for the second fault 812, and third unfaulting operator F3−1 for the third fault 813. These different unfaulting operators may be combined:

$$F_3^{-1}*F_2^{-1}*F_1^{-1} \tag{e1}$$

meaning that first the unfolding operator $F_1^{-1}$ is applied, then $F_2^{-1}$, and lastly $F_3^{-1}$.

The result is the intermediary model 820 that contains three conceptual faults 821, 822, and 823 and one horizon 824. The horizon 824 is still realized, but healed. The horizon 824 does not exhibit any spatial discontinuities. Horizon 824 is continuous, while the base horizon 814 contained discontinuities at the fault locations.

Then, a reduction of the continuous horizon 824 to the conceptual horizon 834 by removal of its geometry is performed. This may be performed by applying the unfolding operator S1−1. The result is model 830, which is the conceptual model having three conceptual faults 821, 822, and 823 and the conceptual horizon 834.

Based on the specified parameter ranges, the conceptual horizon 834 is reinstantiated creating the realized horizon 844 in the reinstantiated model 840. This may be performed by applying the folding operator S1. Without any realized faults, the realized horizon 844 is continuous, but clearly different from horizon 824.

Then, based on the specified parameter ranges, the conceptual fault 822 is reinstantiated creating the realized fault 852 in reinstantiated model 850. This may be performed by applying the folding operator F2. In this specific example, both faults 821 and 823 were randomly determined to remain concepts and are not reinstantiated. The realization of fault 852, however, also introduced throws which that are applied to the continuous horizon 844 creating the faulted, discontinuous horizon 854.

By suppressing the non-instantiated conceptual faults 821 and 823, the final framework realization 860 contains fault 852 and horizon 854. Multiple framework realizations may be instantiated from the concept 830 by using different parameterizations for the conceptual faults 821, 822, and 823 and the conceptual horizon 834. Creating multiple realizations may be useful to lessen uncertainty in the analysis of the realizations with regard to a specified problem, question, or decision.

As may be appreciated, the flow chart of FIG. 1 may include various variations. For example, the concept may be created in block 102. In block 103, an agent selects bounds for deformations and other model parameters. Then, parameters are selected from these bounds, and a realization of the concept is instantiated in block 104.

In certain embodiments, the concept is generated in block 102 by systematic removal of deformations from a base realization. Preferably, the realization is checked for technical validity and/or geologic plausibility in block 105 because some combinations of parameters may result in realizations that are technically invalid or geologically implausible. Realizations that fail this test are either fixed or discarded outright. Then, the realizations are populated with properties in block 106, simulated in block 108, and analyzed in block 110. The analysis results are summarized to facilitate business decisions and operations to produce hydrocarbons.

Figure 9:
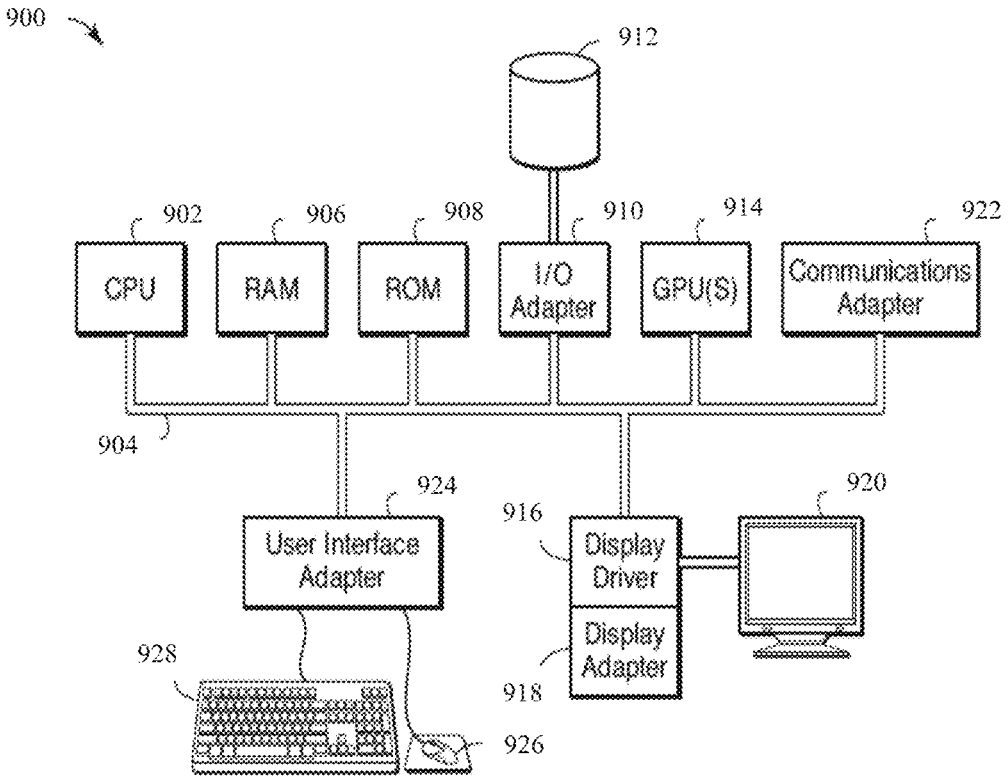
FIG. 9 is a block diagram of a computer system that may be used to perform any of the methods disclosed herein.

As an example, FIG. 9 is a block diagram of a computer system 900 that may be used to perform any of the methods disclosed herein. A central processing unit (CPU) 902 is coupled to system bus 904. The CPU 902 may be any general-purpose CPU, although other types of architectures of CPU 902 (or other components of exemplary system 900)

may be used as long as CPU 902 (and other components of system 900) supports the inventive operations as described herein. The CPU 902 may execute the various logical instructions according to disclosed aspects and methodologies. For example, the CPU 902 may execute machine-level instructions for performing processing according to aspects and methodologies disclosed herein.

The computer system 900 may also include computer components such as a random access memory (RAM) 906, which may be SRAM, DRAM, SDRAM, or the like. The computer system 900 may also include read-only memory (ROM) 908, which may be PROM, EPROM, EEPROM, or the like. RAM 906 and ROM 908 hold user and system data and programs, as is known in the art. The computer system 900 may also include an input/output (I/O) adapter 910, a communications adapter 922, a user interface adapter 924, and a display adapter 918. The I/O adapter 910, the user interface adapter 924, and/or communications adapter 922 may, in certain aspects and techniques, enable a user to interact with computer system 900 to input information.

The I/O adapter 910 preferably connects a storage device(s) 912, such as one or more of hard drive, compact disc (CD) drive, floppy disk drive, tape drive, etc. to computer system 900. The storage device(s) may be used when RAM 906 is insufficient for the memory requirements associated with storing data for operations of embodiments of the present techniques. The data storage of the computer system 900 may be used for storing information and/or other data used or generated as disclosed herein. The communications adapter 922 may couple the computer system 900 to a network (not shown), which may enable information to be input to and/or output from system 900 via the network (for example, a wide-area network, a local-area network, a wireless network, any combination of the foregoing). User interface adapter 924 couples user input devices, such as a keyboard 928, a pointing device 926, and the like, to computer system 900. The display adapter 918 is driven by the CPU 902 to control, through a display driver 916, the display on a display device 920. Information and/or representations of one or more 2D canvases and one or more 3D windows may be displayed, according to disclosed aspects and methodologies.

The architecture of system 900 may be varied as desired. For example, any suitable processor-based device may be used, including without limitation personal computers, laptop computers, computer workstations, and multi-processor servers. Moreover, embodiments may be implemented on application specific integrated circuits (ASICs) or very large scale integrated (VLSI) circuits. In fact, persons of ordinary skill in the art may use any number of suitable structures capable of executing logical operations according to the embodiments.

In one or more embodiments, the method may be implemented in machine-readable logic, set of instructions or code that, when executed, performs a method to analyzing uncertainty of subsurface formations. The code may be used or executed with a computing system such as computing system 900. The computer system may be utilized to store the set of instructions that are utilized to manage the data and other aspects of the present techniques.

As an example, a computer system 900 may be used to analyze uncertainty of subsurface formations for production or exploration operations. The computer system may include a processor; memory in communication with the processor; and a set of instructions stored in memory and accessible by the processor. The set of instructions, when executed by the processor, are configured to: create a conceptual subsurface model, wherein the conceptual subsurface model is associated with a subsurface formation and comprises a plurality of objects; select parameter ranges for each of the plurality of objects and interactions between two or more of the plurality of objects; instantiate realizations for the plurality of objects based on the selected parameter ranges; and combine instantiated realizations of these objects into a reservoir model. The set of instructions are configured to create the conceptual subsurface model may be further configured to automatically create the conceptual subsurface model from an obtained base realization; may be further configured to undo one or more faults and folds in a sequential order; may be further configured estimate parameter ranges based on the undoing of one or more of faults and folds; and may be further configured to unfault an inputted base realization based on fault-horizon cutoff polygons to create the conceptual subsurface model. Further, the set of instructions may be configured to refault from the conceptual subsurface model based on fault-horizon cutoff polygons.

The computer system may include other instructions to enhance efficiency of the operation of the present techniques. For example, the set of instructions may be configured to analyze each of the instantiated realizations for geologic plausibility and, if one or more of the instantiated realizations are determined to be geologically implausible, discard the one or more of the instantiated realizations that are geologically implausible. In addition to or alternatively, the set of instructions may be configured to analyze each of the instantiated realizations for technical consistency and, if one or more of the instantiated realizations are determined to be technically inconsistency, discard the one or more of the instantiated realizations that are technically inconsistency.

In other embodiment, the computer system may include other enhancements. For example, the set of instructions may be configured to instantiate properties into each of the instantiated realizations, wherein the properties comprise one or more of porosity, permeability and oil saturation; may be configured to condition the instantiating properties by perturbing, distorting, or modifying the geometry; and/or may be configured to condition the instantiating properties by applying a sequence of undeformations and redeformations that used to create the instantiated realizations. The set of instructions may be configured to simulate the instantiated realizations; may be configured to simulate using a simulation proxy method; may be configured to simulate proxy method using a connectivity measure as a simulation proxy for each of the instantiated realizations; may be configured to compute the connectivity measure based on graph based centrality measure; may be configured to rank the plurality of instantiated realizations in order of the respective centralization measures; and/or may be configured to simulate the instantiated realizations to create a set of simulations that are analyzed to affect a decision for production operations. Further, the set of instructions configured to create the conceptual subsurface model may be further configured to create two or more instantiated realizations from the concept conceptual subsurface model; may be further configured to create two or more conceptual subsurface models to generate two or more scenarios; and/or may be further configured to create one or more conceptual subsurface models that are each based on different base realizations and are created to generate two or more scenarios.

In some preferred embodiments, simulation may be approximated by a simulation proxy. A preferred simulation proxy is based on graph-based centrality. The centrality measure, which is described in U.S. patent application Ser. No. 14/272,581, which is incorporated by reference, may include one or more of degree, betweenness, closeness, and eigenvector.

A connectivity matrix expresses how well two neighboring grid cells are connected (transmissibility) or how similar a specified property is. In the first case, a connection is weighted; while in the second case, each grid cell is associated with a label or index i and an attribute or property value vi. The two cases are not mutually exclusive: one definition of connection weight is the magnitude of their property or attribute difference. Another preferred definition of connection weight is their property or attribute average. With this definition of connection weight, an off-diagonal element of the connectivity matrix Cij for two neighboring grid cells i and j (where i≠j) is set to −½(vi+vj). A diagonal element Cii of the connectivity matrix is set to $\Sigma\frac{1}{2}\varepsilon_{ij}(v_i+v_j)$ where εij is one when grid cells i and j are neighbors and zero when grid cells i and j not neighbors.

In some preferred embodiments of the inventive method, the diagonal elements of the connectivity matrix are set to zero, effectively removing a self-interaction or self-connectivity.

In some embodiments of the inventive method, specified eigenvectors of the connectivity matrix are used to compute a connectivity measure for the grid cell. The first component of the specified eigenvectors defines the location of the first grid cell in a vector space. The second component of the specified eigenvectors defines the location of the second grid cell in said vector space, and so on for the remaining components and grid cells. For a specified grid cell in said vector space, the shortest distance to any other grid cell in said space defines a measure of connectivity indicating how connected the specified grid cell is to all others. Iterating this process over substantially all grid cells provides a connectivity measure for substantially every grid cell, resulting in a connectivity attribute. For computational efficiency, it may be advantageous to limit for a specified grid cell the search of its nearest grid cell in the vector space. Instead of computing the distance to every other grid cell in said vector space, it is preferable to compute only the distance in said vector space to its original neighbors as indicated by the connectivity matrix.

Details of the distance function are irrelevant. Different distance functions result in different connectivity measures. Any metric or any generalized metric associated with said vector space results in a connectivity measure.

Instead of explicitly computing all or a few specified eigenvectors from the connectivity matrix and using these eigenvectors to compute a distance between grid cells, distances may be computed directly from the connectivity matrix using either an iterative or algebraic process. In the iterative process, the connectivity measure ci is computed iteratively as $$c \Leftarrow dMc + \frac{(1-d)}{N}1$$

until a specified (convergence) criteria is satisfied where d is a small damping coefficient, Mij=1/Cij if Cij≠0 and zero otherwise, N refers to the number of grid cells, and 1 is a vector of dimension N containing only ones. An initial value for c may be 1/N. In the algebraic process, $$c = (1-dM)^{-1}\frac{(1-d)}{N}1,$$

where I is an identity matrix. For computational efficiency, the iterative process is preferably used. U.S. Pat. No. 6,285,999 to Page discloses a method for ranking linked web pages based on similar mathematical notions.

Depending on the specifics of the connectivity matrix, in some embodiments of the inventive method the connectivity matrix is normalized prior to the direct estimation of connectivity measures, for example by scaling each row sum, each columns sum, or each row sum and each column sum of the connectivity matrix C to one.

In graph theory and network analysis, centrality of a vertex measures its relative importance within a graph. Examples include how influential a person is within a social network, how well-used a road is within an urban network, or how well connected the grid cells are within their geobodies or connectivity structures. There are four main measures of centrality: degree, betweenness, closeness, and eigenvector. The connectivity measures disclosed with this invention are examples of eigenvector-based centrality measures.

Degree centrality refers to the number of connections for a specified node, potentially weighted by the attribute value. For the disclosed connectivity matrices, degree centralities or degree-based connectivity measure may be computed by row sums, column sums, or row-column sums, preferably excluding elements on the matrix diagonals from the sum.

In a connected graph, there is a distance metric between any two grid cells belonging to this graph that is defined by the length of the shortest path between the two specified grid cells. The length of a path is defined by the number of connections linking the two specified grid cells, or in the attributed case, by the sum of the attributes along a path linking the specified grid cells. The farness of any grid cell is defined by the sum of its distances to all other grid cells of the graph. Closeness centrality is defined as the inverse of farness. The more central a grid cell is, the lower its total distances to all other grid cells. Closeness centrality can be viewed as a measure of how long it takes to spread information sequentially from a grid cell to all other grid cells belonging to the same graph.

When using permeability to compute the connectivity matrix, the grid cells with the largest closeness centralities or the largest closeness-based connectivity measures are the grid cells that provide fast drainage of a contiguous group of grid cells from their fluids.

Extensions of closeness centrality account not only for the shortest path length but also for the number of paths.

Betweenness centrality quantifies the number of times a grid cell acts as a bridge along the shortest path between any two grid cells of a subsurface model. It may be advantageous to scrutinize grid cells with high betweenness centrality because a small perturbation to the connectivity structure, permeability or transmissibility might dramatically alter the shortest paths and their spatial distributions.

Eigenvector centrality is a measure of the influence of a grid cell in the connected graph of the subsurface model. Eigenvector centrality assigns a relative score to all grid cells based on the principle that connections from a specified grid cell to high-scoring grid cells contribute more to the score of the specified grid cell than connections to low-scoring grid cells. The centrality score or eigenvector-based connectivity measure c can be defined as solution to the eigenvector equation C c=λc. There will typically be multiple eigenvalues λ for which an eigenvector solution exists. The dominant eigenvector associated with the largest eigenvalue is preferably obtained by an iterative process.

In some embodiments of the inventive method, a centralization measure is computed for a group of contiguous grid cells that have been attributed with a specified connectivity measure. Centralization for the specified group of grid cells measures how central its most central grid cell is in relation to all of its other grid cells, for example by computation of $\Sigma c_{max}-c_i$. Preferably, this quantity is normalized by the number of grid cells or the theoretically largest sum of centrality differences for a graph of similar size. It may be advantageous to estimate the theoretically largest sum of centrality differences for a graph of similar size by constructing a compact group of grid cells with the same number of grid cells and maximal connectivity, for example in the shape of a ball. In the attributed case, every grid cell or connection of this ideal group is attributed with a maximal value in accordance to the specified attribute.

In some embodiments of the inventive method, groups of contiguous grid cells (e.g., compartments, segments, zones) are ranked in order of their centralization measures. In some embodiment of the inventive method, the group of contiguous grid cells is formed by thresholding, by definition of a spatial bounding box, or by any other method.

In some preferred embodiments of the inventive method, a connectivity measure is assigned to groups of contiguous grid cells of the reservoir model. The connectivity measure serves as a proxy to a reservoir simulation or reservoir performance analysis. Proxy simulations for performance prediction are well known to practitioners of the art. Examples of such proxy simulations may be European Patent No. 1,994,488 to Li et al entitled "Method for Quantifying Reservoir Connectivity Using Fluid Travel Times", U.S. Pat. No. 8,437,997 to Meurer et al entitled 'Dynamic Connectivity Analysis', U.S. Pat. No. 7,164,990 to Bratvedt et al entitled "Method Of Determining Fluid Flow", or Hirsch and Schuette, "Graph Theory Applications To Continuity And Ranking In Geologic Models", Computers & Geosciences, 25(2), 127-139, 1999. All these proxies, however, are source-target proxies where some grid cells or cells are designated to be sources or injectors and other grid cells are designated as targets, sinks, or producers. Sources, targets and conductors (i.e., grid cells that are neither sources nor sinks) are mutually exclusive. The purpose of these proxies is the analysis of different reservoir development or production scenarios to examine the connectivity between the oil-bearing reservoir and the producer wells or the connectivity between water-injection wells and hydrocarbon-production wells. The novel connectivity measures disclosed in this publication are independent of sources and targets. No well locations need to be specified. Grid cells do not need to be separated into mutually exclusive sources, sinks, and conductors. Instead, each grid cell is compared to all others. Each grid cell acts simultaneously as source, sink, and conductor. The disclosed connectivity measures allow examination of the model for highly connected regions, for disconnected compartments, for barriers, and regions where small even perturbations of connectivity and attributes or properties (porosity, permeability, or transmissibility) will change long-distance connectivity by disconnecting one region or compartment into multiple ones or connecting multiple regions or compartments into one, thus warranting additional scrutiny to analyze these sensitive regions.

It should be understood that the preceding is merely a detailed description of specific embodiments of the invention and that numerous changes, modifications, and alternatives to the disclosed embodiments can be made in accordance with the disclosure here without departing from the scope of the invention. The preceding description, therefore, is not meant to limit the scope of the invention. Rather, the scope of the invention is to be determined only by the appended claims and their equivalents. It is also contemplated that structures and features embodied in the present examples can be altered, rearranged, substituted, deleted, duplicated, combined, or added to each other. The articles "the", "a" and "an" are not necessarily limited to mean only one, but rather are inclusive and open ended so as to include, optionally, multiple such elements.

What is claimed is:

1. A method for analyzing uncertainty of subsurface formations comprising:

providing a base realization of a subsurface model, wherein the base realization is a subsurface model having one or more properties and comprises at least one fault or fold;

creating a concept model comprising a plurality of objects, wherein the concept model is created from the base realization by undoing at least one fault or fold in the base realization and wherein properties of the subsurface model related to geometry and location of the undone faults and folds are suppressed in the concept model;

selecting, for the concept model, parameter ranges for each of the plurality of objects and interactions between two or more of the plurality of objects;

instantiating a plurality of realizations of the concept model based on the selected parameter ranges where the plurality of realizations are obtained by systematic variation of parameters within the selected parameter ranges or by random sampling of the parameter ranges using a stochastic process, wherein in each of the plurality of instantiated realizations the geometry and location of at least one of the undone faults and folds have been re-assigned;

analyzing each of the plurality of instantiated realizations for geologic plausibility and technical consistency and, if an instantiated realization is determined to be geologically implausible or technically inconsistent, discarding the geologically implausible instantiated realizations and discarding the technically inconsistent instantiated realizations;

instantiating properties into each of the undiscarded instantiated realizations;

conditioning the instantiating properties by perturbing, distorting, or modifying geometry of conditioning data, where the conditioning data is perturbed, distorted, or modified using the same sequence of undeformations and redeformations used to create the concept model;

simulating the populated instantiated realizations, wherein the simulation is performed using a simulation proxy method using a connectivity measure as a simulation proxy for each of the instantiated realizations, wherein the connectivity measure is based on graph based centrality measure; and analyzing the simulations to identify hydrocarbons in the subsurface formation.

2. The method of claim 1, wherein the parameter ranges are estimated based on the undoing of the at least one fault or fold.

3. The method of claim 1, wherein creating the concept model comprises unfaulting the base realization based on fault-horizon cutoff polygons.

4. The method of claim 1, wherein instantiating realizations comprises refaulting the concept model based on fault-horizon cutoff polygons.

5. The method of claim 1, wherein the properties comprise one or more of porosity, permeability and oil saturation.

6. The method of claim 1, further comprising conditioning the instantiating properties by applying a sequence of undeformations and redeformations that used to create the instantiated realizations.

7. The method of claim 1, wherein centrality measure is one of degree, betweenness, closeness, and eigenvector.

8. The method of claim 1, further comprising ranking the plurality of instantiated realizations in order of the respective centralization measures.

9. The method of claim 1, wherein simulating the populated instantiated realizations creates a set of simulations that are analyzed to affect a decision for production operations.

10. A computer system for analyzing uncertainty of subsurface formations comprising:

a processor;

memory in communication with the processor; and a set of instructions stored in memory and accessible by the processor, the set of instructions, when executed by the processor, are configured to:

providing a base realization of a subsurface model, wherein the base realization is a subsurface model having one or more properties and comprises at least one fault or fold;

create a concept model comprising a plurality of objects, wherein the concept model is created from the base realization by undoing at least one fault or fold in the base realization, and wherein properties of the subsurface model related to geometry and location of the undone faults and folds are suppressed in the concept model;

select, for the concept model, parameter ranges for each of the plurality of objects and interactions between two or more of the plurality of objects;

instantiate a plurality of realizations of the concept model based on the selected parameter ranges where the plurality of realizations are obtained by systematic variation of parameters within the selected parameter ranges or by random sampling of the parameter ranges using a stochastic process, wherein in each of the plurality of instantiated realizations the geometry and location of at least one of the undone faults and folds have been re-assigned;

analyze each of the a plurality of instantiated realizations for geologic plausibility and technical consistency and, if an instantiated realization is determined to be geologically implausible or technically inconsistent, discarding the geologically implausible instantiated realization and discarding the technically inconsistent instantiated realization;

instantiate properties into each of the undiscarded instantiated realizations;

condition the instantiating properties by perturbing, distorting, or modifying geometry of conditioning data, where the conditioning data is perturbed, distorted, or modified using the same sequence of undeformations and redeformations used to create the concept model;

simulate the populated instantiated realizations, wherein the simulation is performed using a simulation proxy method using a connectivity measure as a simulation proxy for each of the instantiated realizations, wherein the set of instructions are configured to compute the connectivity measure based on graph based centrality measure; and analyze the simulations to identify hydrocarbons.

11. The computer system of claim 10, wherein the set of instructions are configured to estimate parameter ranges based on the undoing of one or more of faults and folds.

12. The computer system of claim 10, wherein the set of instructions are configured to create the concept model by unfaulting the base realization based on fault-horizon cutoff polygons.

13. The computer system of claim 10, wherein the set of instructions are configured to refault from the concept model based on fault-horizon cutoff polygons.

14. The computer system of claim 10, wherein the properties comprise one or more of porosity, permeability and oil saturation.

15. The computer system of claim 10, wherein the set of instructions are configured to condition the instantiating properties by applying a sequence of undeformations and redeformations that used to create the instantiated realizations.

16. The computer system of claim 10, wherein the set of instructions are configured to rank the plurality of instantiated realizations in order of the respective centralization measures.

17. The computer system of claim 10, wherein the set of instructions are configured to simulate the instantiated realizations to create a set of simulations that are analyzed to affect a decision for production operations.

* * * * *